US008985733B2

(12) United States Patent
Terada

(10) Patent No.: US 8,985,733 B2
(45) Date of Patent: Mar. 24, 2015

(54) PATTERN INSPECTION APPARATUS, PATTERN INSPECTION METHOD, AND PRINTER

(71) Applicant: Kohei Terada, Kiyosu (JP)

(72) Inventor: Kohei Terada, Kiyosu (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/220,657

(22) Filed: Mar. 20, 2014

(65) Prior Publication Data

US 2014/0292888 A1 Oct. 2, 2014

(30) Foreign Application Priority Data

Mar. 29, 2013 (JP) ..... 2013-072322

(51) Int. Cl.

| | |
|---|---|
| ***B41J 29/393*** | (2006.01) |
| ***B41J 2/21*** | (2006.01) |
| ***B41J 11/42*** | (2006.01) |
| ***B41J 2/13*** | (2006.01) |
| ***B41J 2/045*** | (2006.01) |

(52) U.S. Cl.

CPC ..... *B41J 29/393* (2013.01); *B41J 2/2132* (2013.01); *B41J 2/2135* (2013.01); *B41J 2/2139* (2013.01); *B41J 11/42* (2013.01); *B41J 2/13* (2013.01); *B41J 2/04505* (2013.01); *B41J 2/04506* (2013.01); *B41J 2/04558* (2013.01); *B41J 2029/3935* (2013.01)

USPC ..... 347/19

(58) Field of Classification Search

CPC .. B41J 29/393; B41J 2/04506; B41J 2/04558; B41J 2/04505; B41J 2/2139; B41J 2/2135; B41J 11/42; B41J 2/2132; B41J 2029/3935

See application file for complete search history.

(56) References Cited

U.S. PATENT DOCUMENTS

| | | | | |
|---|---|---|---|---|
| 2006/0158475 | A1 * | 7/2006 | Arquilevich et al. | 347/19 |
| 2006/0214976 | A1 | 9/2006 | Iwao et al. | |

FOREIGN PATENT DOCUMENTS

| | | |
|---|---|---|
| JP | 2005-103934 | 4/2005 |
| JP | 2006-264041 | 10/2006 |
| JP | 2009-274234 | 11/2009 |

* cited by examiner

*Primary Examiner* — Julian Huffman

(74) *Attorney, Agent, or Firm* — Frommer Lawrence & Haug LLP

(57) ABSTRACT

A pattern inspection apparatus is provided, including a reading mechanism configured to read a print pattern including an overlapped pattern portion formed by overlapping a first-pattern and a second-pattern and a single pattern portion formed with only any one of the first-pattern and the second-pattern; and a controller configured to perform acquisition of density information of the print pattern based on a result of the reading and correction of density information of the overlapped pattern portion by using density information of the single pattern portion.

18 Claims, 14 Drawing Sheets

POSITION
BRIGHTNESS
OVERLAPPED PATTERN PORTION
SCANNING DIRECTION
LEFT
RIGHT
TRANSPORTING DIRECTION
100
101
102
111
111a
112
112a
121
121a
122
123
131
132
133
9
10
12

PATTERN INSPECTION APPARATUS, PATTERN INSPECTION METHOD, AND PRINTER

The present application claims priority from Japanese Patent Application No. 2013-072322, filed on Mar. 29, 2013, the disclosure of which is incorporated herein by reference in its entirety.

BACKGROUND OF THE INVENTION

1. Field of the Invention

The present invention relates to a pattern inspection apparatus and a pattern inspection method in which inspection is performed by reading a print pattern printed by a printer, and a printer in which a print pattern is printed and inspection is performed by reading the printed print pattern.

2. Description of the Related Art

Conventionally, an ink-jet printer is known, in which the printing is performed by discharging ink from a printing head carried on a carriage while reciprocatively moving the carriage in a scanning direction. In a certain ink-jet printer, ink is discharged from certain nozzles while moving a carriage in the scanning direction to thereby print a linear reference pattern extending in the main scanning direction. Subsequently, the recording paper P is transported by a certain distance, and then the ink is discharged from nozzles positioned on the downstream side in the transport direction as compared with the nozzles having been used to print the reference pattern, while moving the carriage in the scanning direction to thereby print an adjusting pattern extending linearly in the scanning direction. Accordingly, an error detecting print pattern, which is composed of the reference pattern and the adjusting pattern, is printed. The printing of the reference pattern and the adjusting pattern as described above is performed a plurality of times while changing the transport distance of the recording paper P, and thus a plurality of error detecting print patterns are printed. The plurality of error detecting print patterns are read by using an optical sensor to acquire densities of the respective error detecting print patterns. In this context, the density of the print pattern is the ratio of the areal size of the pattern portion to which the ink is adhered with respect to the areal size of the portion (white background portion) at which the recording medium is exposed. In this procedure, the acquired density is the lowest in relation to the error detecting print pattern in which the reference pattern and the adjusting pattern are overlapped to the greatest extent. Accordingly, in the ink-jet printer described above, the transport amount, which is provided when the error detecting print pattern having the lowest acquired density, is used as the transport amount to be used during the printing.

In relation thereto, in the case of the ink-jet printer in which the printing is performed by discharging the ink from the plurality of nozzles, any abnormality arises in a part of the reference pattern or the adjusting pattern, for example, such that a part of the reference pattern or the adjusting pattern is not printed and/or any dispersion arises in the thickness of the reference pattern or the adjusting pattern. For example, when the printing of the reference pattern and the adjusting pattern is repeatedly performed as in the ink-jet printer described above, the following situation sometimes arises. That is, the ink is not discharged upon the ink discharge performed for the first time during the printing of the reference pattern or the adjusting pattern performed for the first time, and a part of the reference pattern or the adjusting pattern is not printed. Further, the following situation sometimes arises. That is, the discharge speed and/or the volume of the ink discharged from the nozzles is/are fluctuated, and any dispersion arises in the thickness of the reference pattern or the adjusting pattern, on account of the temporarily unstable voltage supplied from a power source to the ink-jet printer, the vibration of the surface on which the ink-jet printer is arranged, and/or the change of the direction of the force applied to the ink contained in the ink-jet head during the acceleration or deceleration of the carriage depending on the movement direction of the carriage.

In this way, if any abnormality arises in a part of the reference pattern or the adjusting pattern, the density, which is acquired from the reading result obtained by reading the error detecting print pattern by means of the optical sensor, is consequently different from the density which is to be originally or normally acquired. As a result, it is feared that the error detecting print pattern, which includes any abnormal reference pattern or any abnormal adjusting pattern and which is different from the error detecting print pattern that is to originally have the lowest density, may be judged as the pattern which has the lowest density, and it is impossible to appropriately set the transport amount.

SUMMARY OF THE INVENTION

An object of the present invention is to provide a pattern inspection apparatus, a pattern inspection method, and a printer which make it possible to acquire the density information while excluding the influence exerted, for example, by any abnormality of each of patterns in a print pattern formed by overlapping the two patterns.

According to a first aspect of the present invention, there is provided a pattern inspection apparatus configured to inspect a print pattern printed on a medium by a printer, including:

a reading mechanism configured to read the print pattern including an overlapped pattern portion in which a first-pattern and a second-pattern are overlapped and a single pattern portion in which one of the first-pattern and the second-pattern is formed without overlapping; and a controller configured to acquire density information of the print pattern based on a result of the reading performed by the reading mechanism and to correct density information of the overlapped pattern portion by using density information of the single pattern portion.

According to a second aspect of the present invention, there is provided a pattern inspection method for inspecting a print pattern printed on a medium by a printer, including:

reading, by a reading apparatus, the print pattern printed on the medium by the printer, the print pattern including an overlapped pattern portion in which a first-pattern and a second-pattern are overlapped and a single pattern portion in which one of the first-pattern and the second-pattern is formed without overlapping;

acquiring density information of the print pattern based on a result of the reading; and correcting density information of the overlapped pattern portion by using density information of the single pattern portion.

According to a third aspect of the present invention, there is provided a printer configured to perform printing on a medium, including:

a print unit which is configured to print a print pattern on the medium;

a read unit which is configured to read the print pattern printed on the medium; and a controller which is configured to control the print unit and the read unit to perform:

printing of the print pattern including an overlapped pattern portion in which a first-pattern and a second-pattern are overlapped and a single pattern portion in which one of the first-pattern and the second-pattern is formed without overlapping, by controlling the print unit;

acquisition of density information of the print pattern based on a result of the reading; and correction of density information of the overlapped pattern portion by using density information of the single pattern portion.

According to the inventions described above, the density information of the overlapped pattern portion is corrected by using the density information of the single pattern portion formed with only the first-pattern or the second-pattern. Therefore, even when any abnormality or the like exists in a part of the first-pattern or the second-pattern, it is possible to exclude the influence of the density change caused by the abnormality or the like.

DESCRIPTION OF THE PREFERRED EMBODIMENTS

First Embodiment

Figure 1:
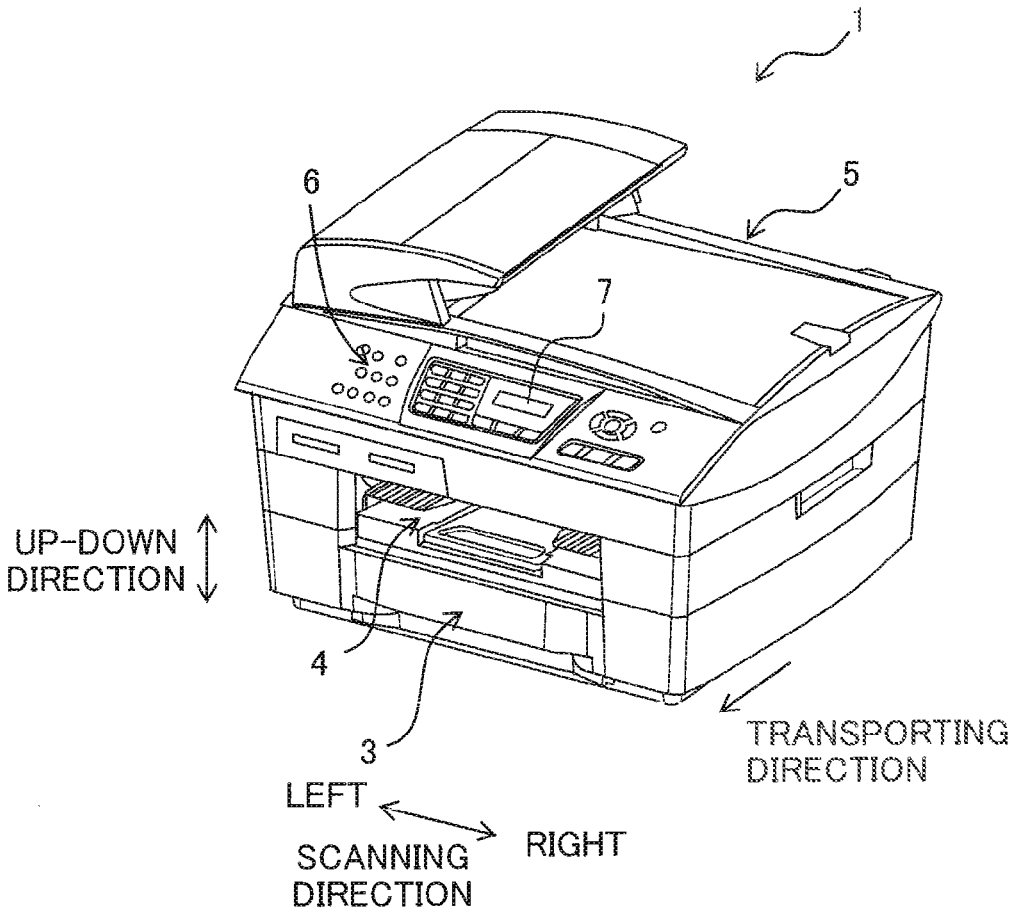
FIG. 1 shows a schematic arrangement of a printer according to a first embodiment.

A first embodiment of the present teaching will be explained below.

A printer 1 according to a first embodiment (corresponding to a printer of the present teaching) is a so-called multifunction machine which is capable of performing, for example, the reading of an image, as well as the printing on the recording paper P. The ink-jet printer 1 is provided with, for example, a print unit (see FIG. 2), a paper feeding unit 3, a paper discharging unit 4, a read unit 5, an operation unit 6, and a display unit 7. The operation of the ink-jet printer 1 is controlled by a controller 50 (see FIG. 3).

The print unit 2 is provided at the inside of the ink-jet printer 1, and the print unit 2 performs the printing on the recording paper P. Detailed arrangement of the print unit 2 will be explained later on. The paper feeding unit 3 is the portion to arrange, for example, a recording paper tray in which the recording paper P to be supplied to the print unit 2 is accommodated. The paper discharging unit 4 is the portion to which the recording paper P having been subjected to the printing by the print unit 2 is discharged. The read unit 5 is, for example, a scanner, and the read unit 5 is the portion to perform the reading of an image. The operation unit 6 is provided with, for example, buttons. A user performs the necessary operation with respect to the ink-jet printer 1 by operating, for example, the buttons of the operation unit 6. The display unit 7 is, for example, a liquid crystal display, and the display unit 7 displays information which is required when the ink-jet printer 1 is used.

Figure 2:
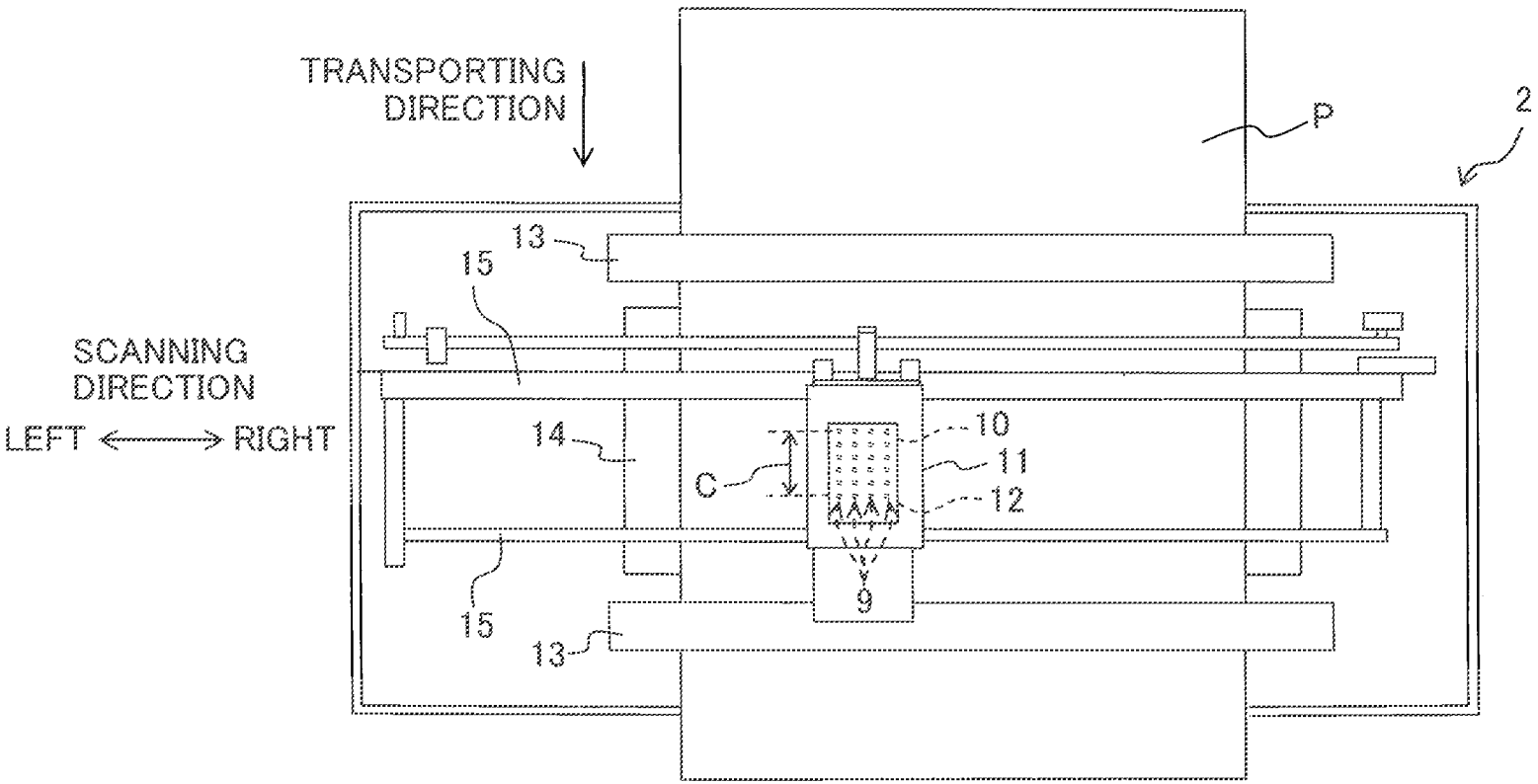
FIG. 2 shows a schematic arrangement of a print unit provided in the printer shown in FIG. 1.

Next, the print unit 2 will be explained. As shown in FIG. 2, the print unit 2 is provided with a carriage 11, an ink-jet head 12, transporting rollers 13, and a platen 14.

The carriage 11 is reciprocatively movable in the scanning direction by being guided by guide rails 15. The following explanation will be made while the right side and the left side in the scanning direction are defined as shown in FIG. 2. The ink-jet head 12 is carried on the carriage 11, and the ink-jet head 12 discharges inks from a plurality of nozzles 10 formed on the lower surface thereof. The plurality of nozzles 10 are arranged to form four nozzle arrays 9, and the respective nozzle arrays 9 are arranged over a length C in the transport direction perpendicular to the scanning direction. The four nozzle arrays 9 are aligned in the scanning direction. The black, yellow, cyan, and magenta inks are discharged from the plurality of nozzles 10 in this order as starting from those which form the nozzle array 9 disposed on the right side in the scanning direction.

The transporting roller 13 is arranged on the both sides of the ink-jet head 12 in the transport direction, and the transporting roller 13 transports the recording paper P in the transport direction. The platen 14 is arranged to face the lower surface of the ink-jet head 12, and the platen 14 supports, at the lower position, the portion of the recording paper P transported by the transporting rollers 13, the portion facing the ink-jet head 12.

In the print unit 2, the inks are discharged from the ink-jet head 12 which is moved reciprocatively in the scanning direction together with the carriage 11, while intermittently transporting the recording paper P in the transport direction by means of the transporting rollers 13. Thus, the printing is performed on the recording paper P.

Figure 3:
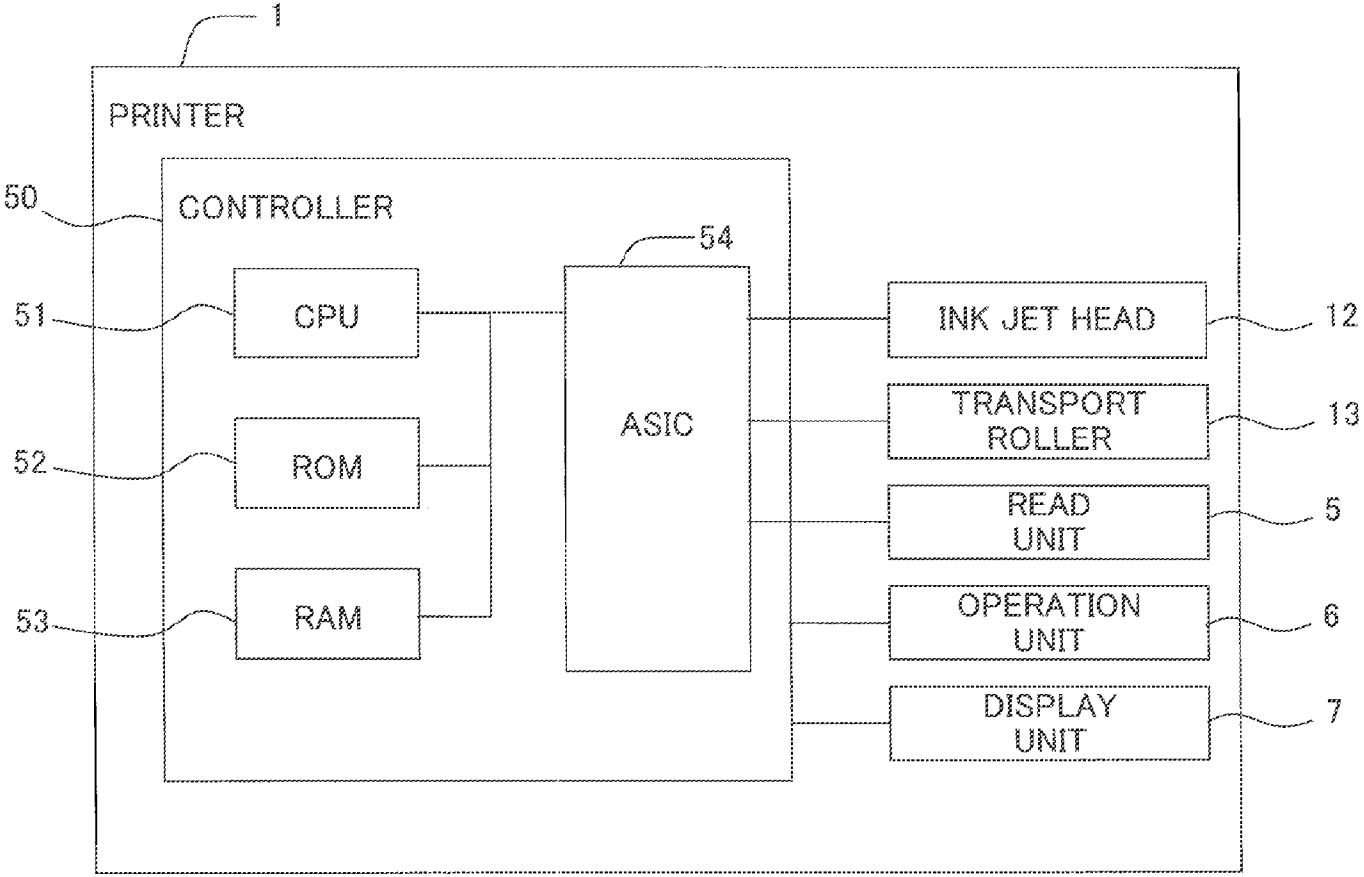
FIG. 3 shows a block diagram illustrating a hardware arrangement of the printer.

Next, an explanation will be made about the controller 50 provided to control the operation of the ink-jet printer 1. As shown in FIG. 3, the controller 50 is provided with, for example, a Central Processing Unit 51 (a CPU 51), a Read Only Memory 52 (a ROM 52), a Random Access Memory 53 (a RAM 53), and an ASIC 54. In the controller 50, the CPU 51 and the ASIC 54 cooperatively perform the control necessary for the operation of the printer 1, including, for example, the ordinary printing performed by the print unit 2, the printing of an inspection image (image for inspection) as described later on, the reading of the image by the read unit 5, and the processing for the result of reading of the image. Accordingly, the controller 50 operates, for example, as the density acquiring mechanism, the position specifying mechanism, and the inclination detecting mechanism of the present teaching. Only one CPU 51 is shown in FIG. 3 for the purpose of convenience. However, the controller 50 may include only one CPU 51 and one CPU 51 may perform the processing. Alternatively, the controller 50 may include a plurality of CPU's 51 and the plurality of CPU's 51 may perform the processing in a shared manner. Further, only one ASIC 54 is shown in FIG. 3 for the purpose of convenience. However, the controller 50 may include only one ASIC 54 and ASIC 54 may perform the processing. Alternatively, the controller 50 may include a plurality of ASICs 54 and the plurality of ASICs 54 may perform the processing in a shared manner.

In the first embodiment, as described above, the plurality of nozzles 10, which form the respective nozzle arrays 9, are arranged in the transport direction. However, the arrangement direction of the nozzles 10 is inclined with respect to the transport direction in some cases at the stage at which the carriage 11 is assembled to the guide rails 15, for example, due to the production error of, for example, the carriage 11 and/or the guide rails 15. Accordingly, in the first embodiment, the following inspection is performed, and the direction of the carriage 11 is adjusted in accordance with the inspection result.

Figure 4A:
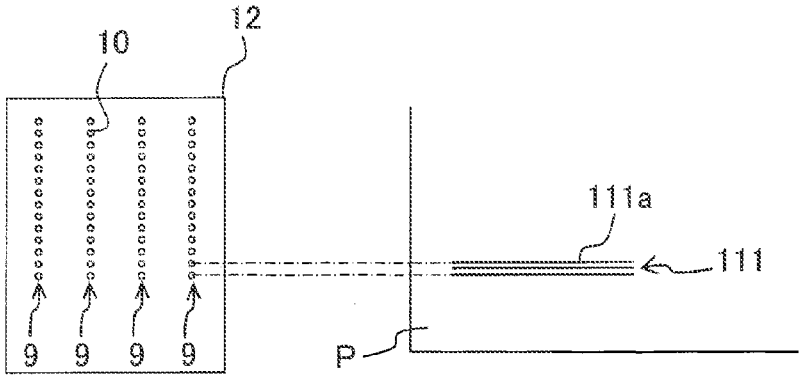
FIGS. 4A, 4B and 4C show steps illustrating a printing procedure for an inspection pattern (pattern for inspection) in the first embodiment.
Figure 5A:
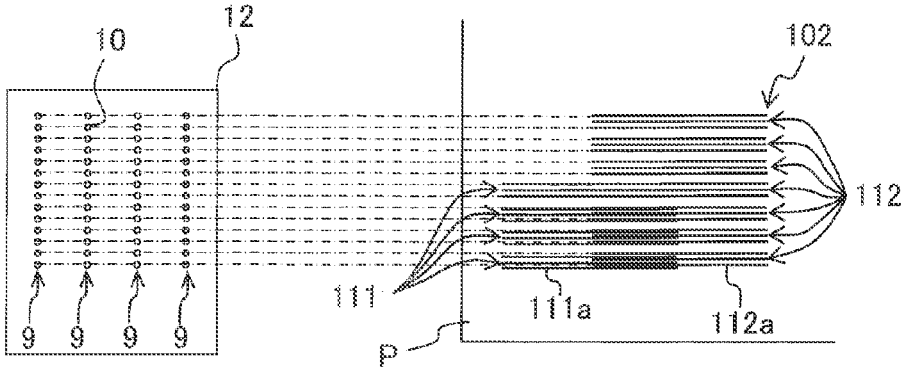
FIGS. 5A, 5B and 5C show steps to be performed after those shown in FIGS. 4A to 4C, of the printing procedure for the inspection pattern in the first embodiment.
Figure 5B:
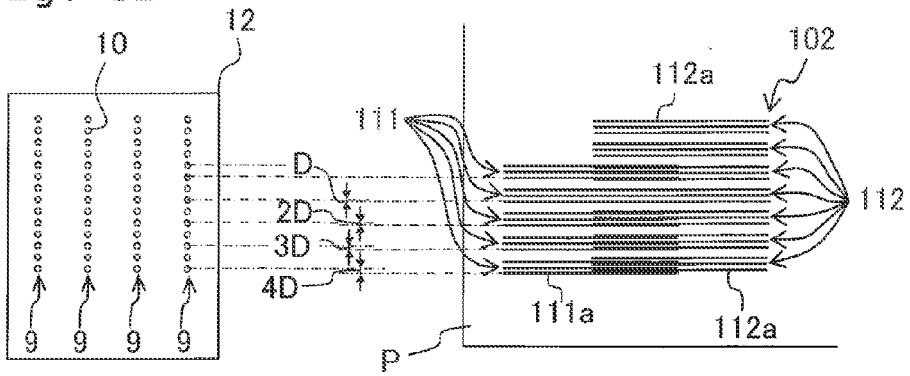
Figure 5C:
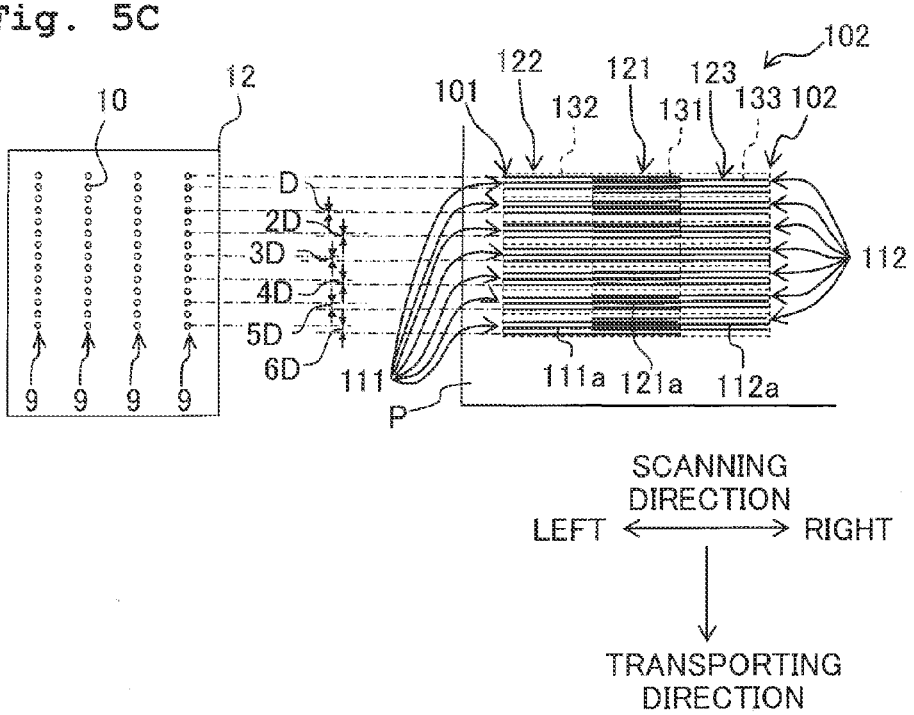

Specifically, an inspection pattern (pattern for inspection) 100 as shown in FIG. 5C is firstly printed. A program, which allows the printer 1 to perform the printing of the inspection pattern 100, is stored, for example, in the ROM 52 of the controller 50. A printing procedure of the inspection pattern 100 will be explained. At first, as shown in FIG. 4A, the black ink is discharged from M pieces of the nozzles 10 as counted from the downstream side in the transport direction, of the plurality of nozzles 10 for forming the nozzle array 9 positioned on the rightmost side in the scanning direction, while moving the carriage 11 in the scanning direction. In this way, a first-partial pattern 111, which is composed of M pieces of first line patterns 111*a*, is printed on the recording paper P. The M pieces of first line patterns 111*a* extend in the scanning direction respectively, and they are arranged at equal intervals in the transport direction. In this case, in FIG. 3, only two of the M pieces of nozzles 10 are illustrated for the purpose of convenience, and only three of the M pieces of first line patterns 111*a* are illustrated. The illustration is also made in the other drawings in the same manner as described above.

Figure 4B:
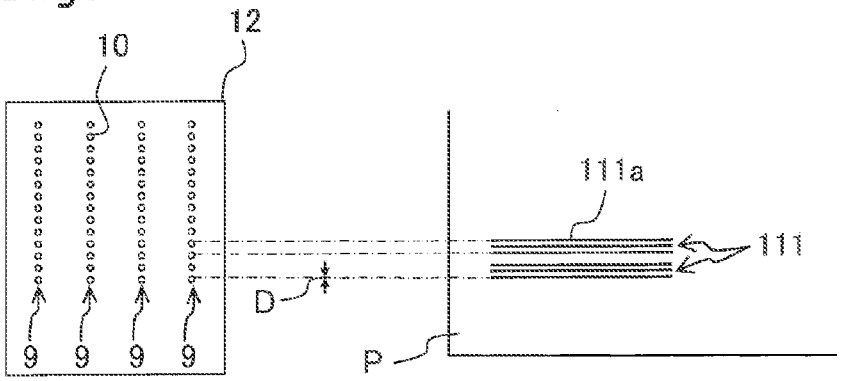
Figure 4C:
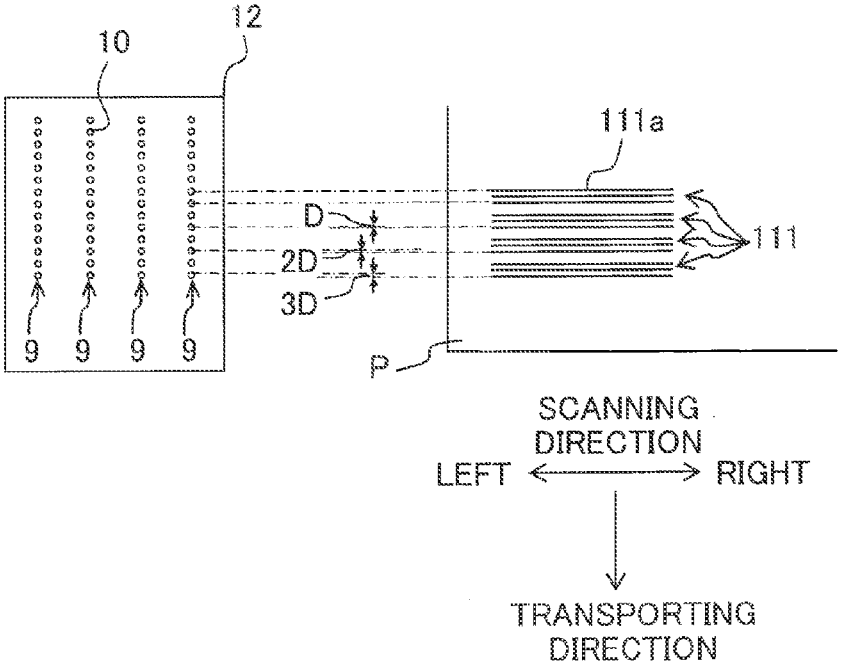

Subsequently, as shown in FIG. 4B, the recording paper P is transported by a minute distance D (first offset amount of the present teaching) by means of the transporting rollers 13. Further, the black ink is discharged from M pieces of the nozzles 10 disposed adjacently on the upstream side in the transport direction of the M pieces of nozzles 10 having been used for the printing of the first-partial pattern 111 just before, while moving the carriage 11 in the scanning direction. In this way, a first-partial pattern 111 is printed on the recording paper P. After that, the transport of the recording paper P performed by the transporting rollers 13 and the printing of the first-partial pattern 111 are repeatedly performed in the same manner as described above. As shown in FIG. 4C, [(N+1)/2] pieces (N is an odd number) of the first-partial patterns 111, which are aligned in the transport direction, are printed on the recording paper P. FIG. 4C shows the situation provided at the point in time at which the printing is performed until the fourth (4=(7+1)/2) first-partial pattern 111 in the case of N=7. It is noted that N represents the number to express what number of first-partial pattern or patterns 111 is/are to be printed, and N can be set to an arbitrary natural number, if necessary. In the following explanation, N pieces of first-partial patterns 111 are referred to as "N blocks of first-partial patterns 111" in some cases.

Subsequently, as shown in FIG. 5A, the magenta ink is discharged from M×N pieces of the nozzles 10 as counted from the downstream side in the transport direction of the nozzle array 9 positioned on the leftmost side in the scanning direction, while moving the carriage 11 in the scanning direction, without transporting the recording paper P from the state shown in FIG. 4C. Accordingly, a second-pattern 102 is printed on the recording paper P. The second-pattern 102 is such a pattern that N blocks of second-partial patterns 112, each of which is composed of M pieces of second line patterns 112*a*, are aligned in the transport direction. The M pieces of second line patterns 112*a* are the patterns formed by the ink discharged from the M pieces of nozzles 10 arranged adjacently. The M pieces of second line patterns 112*a* extend in the scanning direction respectively, and they are arranged in the transport direction. In this case, in the first embodiment, the recording paper P is not transported during the period in which the N blocks of second-partial patterns 112 are printed as described above. That is, in the first embodiment, the second offset amount of the present teaching is zero. In this procedure, the second line patterns 112*a* are printed on the right side in the scanning direction with respect to the first line patterns 111*a* by an amount shorter than the length in the scanning direction of the line patterns 111*a*, 112*a*.

Subsequently, the transport of the recording paper P by the minute distance D performed by the transporting rollers 13 and the printing of the first-partial pattern 111 are repeatedly performed in the same manner as described above. Thus, as shown in FIG. 5B, the [(N−1)/2] blocks of first-partial patterns 111, which are aligned in the transport direction, are printed on the portion of the recording paper P disposed on the upstream side in the transport direction of the [(N+1)/2] blocks of first-partial patterns 111 described above. Accordingly, as shown in FIG. 5C, the first-pattern 101, which is formed by aligning the N blocks of first-partial patterns 111 in the transport direction, is printed on the recording paper P.

The first-pattern 101 and the second-pattern 102 are printed as described above. Accordingly, as shown in FIG. 5C, the inspection pattern 100, which includes the first-pattern 101 and the second-pattern 102, is printed on the recording paper P. The inspection pattern 100 has an overlapped pattern portion 121, a first single pattern portion 122, and a second single pattern portion 123.

The overlapped pattern portion 121 is the portion which is positioned at a substantially central portion of the inspection pattern 100 in the scanning direction and at which the first-pattern 101 and the second-pattern 102 are overlapped with each other. In the overlapped pattern portion 121, the first-partial pattern 111, which is printed at the Kth position (K=1, 2, . . . N) (hereinafter simply referred to as "K-th") from the downstream side in the transport direction, is overlapped with the K-th second-partial pattern 112. The following explanation will be made assuming that the portion of the overlapped pattern portion 121, at which the K-th first-partial pattern 111 and the K-th second-partial pattern 112 are overlapped with each other, is referred to as "K-th overlapped portion 121*a*".

The first single pattern portion 122 is the portion which is positioned on the left side in the scanning direction of the overlapped pattern portion 121 and which is formed with only the first-pattern 101. The second single pattern portion 123 is the portion which is positioned on the right side in the scanning direction of the overlapped pattern portion 121 and which is formed with only the second-pattern 102.

Subsequently, the printed inspection pattern 100 is read by the read unit 5 of the printer 1 to thereby acquire the brightness (density information of the present teaching) of the respective portions of the overlapped pattern portion 121 and the single pattern portions 122, 123 of the inspection pattern 100 (a step of reading of the present teaching). Specifically, the overlapped pattern portion 121 is comparted into a plurality of areas 131 in each of which only one overlapped portion 121*a* is arranged, and the brightness of the respective areas 131 are acquired. Further, the first single pattern portion 122 is comparted into a plurality of areas 132 in each of which only one first-partial pattern 111 is arranged, and the brightness of the respective areas 132 are acquired. Further, the second single pattern portion 123 is comparted into a plurality of areas 133 in each of which only one second-partial pattern 112 is arranged, and the brightness of the respective areas 133 are acquired. In this procedure, the brightness, which is acquired by reading the inspection pattern 100 by the read unit 5, is more lowered at the portion at which the density of each of the overlapped pattern portion 121 and the single pattern portions 122, 123 is higher. That is, the acquisition of the brightness of each of the overlapped pattern portion 121 and the single pattern portions 122, 123 is equivalent to the acquisition of the density of each of the overlapped pattern portion 121 and the single pattern portions 122, 123.

Subsequently, the brightness of each of the areas 131 of the overlapped pattern portion 121 is corrected by subtracting the brightness of the corresponding areas 132, 133 of the single pattern portions 122, 123 from the brightness of each of the areas 131 of the overlapped pattern portion 121 (a step of acquiring a density of the present teaching). Subsequently, the area 131 having the highest brightness is specified on the basis of the density of each of the areas 131 of the overlapped pattern portion 121 after the correction. Thus, the position in the transport direction is specified for the overlapped portion 121*a* which has the largest degree of the overlap between the first line pattern 111*a* and the second line pattern 112*a* (a step of specifying a position of the present teaching). Further, the inclination of the arrangement direction of the nozzles 10 with respect to the transport direction is detected on the basis of the position of the specified overlapped portion 121*a* (a step of detecting an inclination).

Figures 6A, 6B, 6C, 6D:
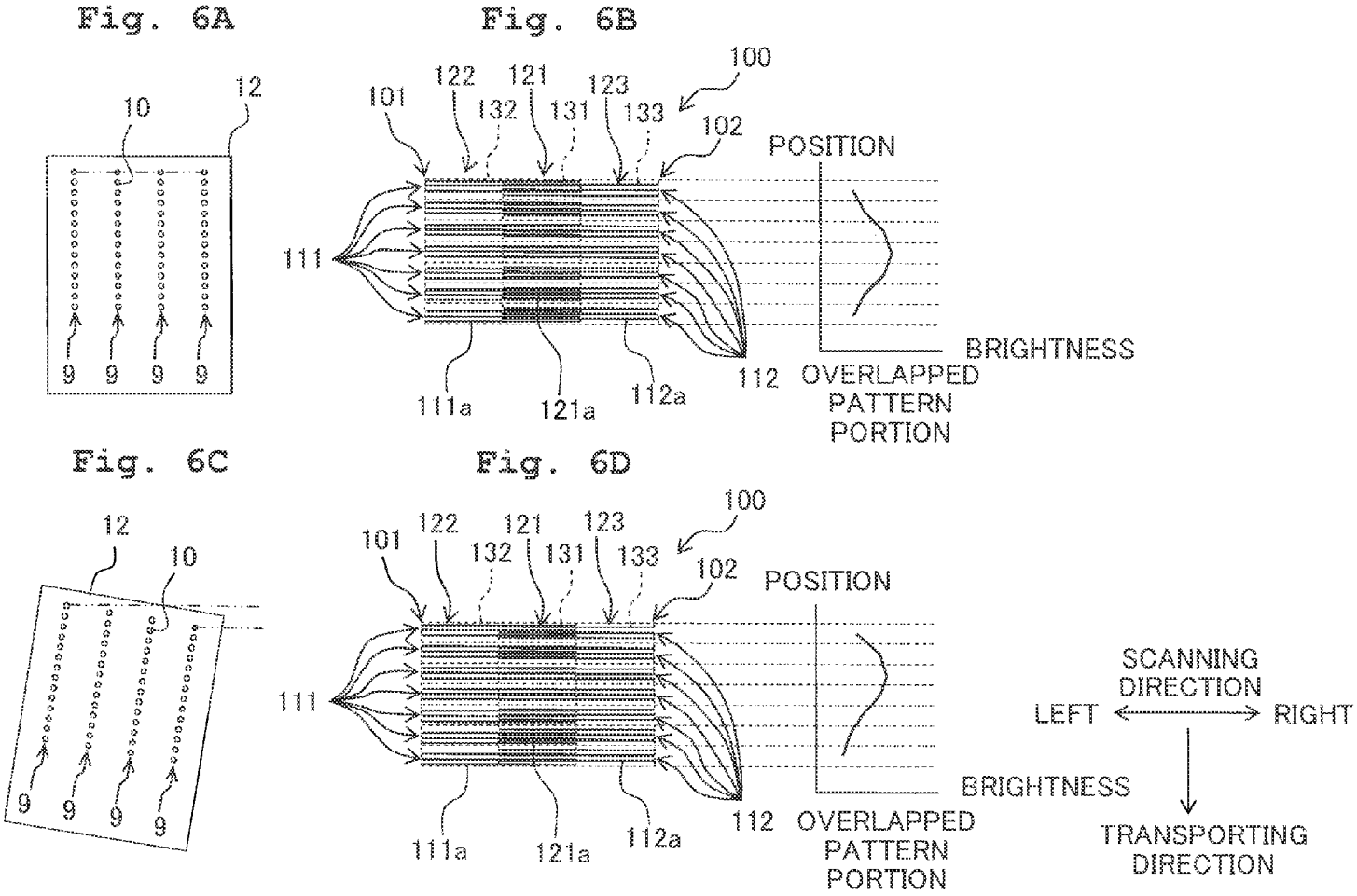
FIG. 6A shows an ink-jet head in which the nozzle arrangement direction is parallel to the transport direction.
FIG. 6B shows a printing result of the inspection pattern in the case of FIG. 6A.
FIG. 6C shows an ink-jet head in which the nozzle arrangement direction is inclined with respect to the transport direction.
FIG. 6D shows a printing result of the inspection pattern in the case of FIG. 6C.

This procedure will be explained in further detail below. In the first embodiment, the [(N+1)/2]th first-partial pattern 111 is printed, and then the N blocks of second-partial patterns 112 are printed without transporting the recording paper P. On the other hand, in the case of the ink-jet head 12 of the first embodiment, the position in the transport direction of the nozzle 10 for constructing each of the nozzle array is identical in relation to any nozzle array 9. Therefore, when the arrangement direction of the nozzles 10 is parallel to the transport direction, as shown in FIG. 6A, the nozzle 10, which forms the nozzle array 9 disposed on the rightmost side and which is used to print the first line pattern 111*a*, is overlapped in the scanning direction with the nozzle 10 which forms the nozzle array 9 disposed on the leftmost side and which is used to print the second line pattern 112*a*. Therefore, when the arrangement direction of the nozzles 10 is parallel to the transport direction, as shown in FIG. 6B, the first line pattern 111*a* and the second line pattern 112*a* are overlapped with each other substantially completely at the [(N+1)/2]th overlapped portion 121*a*. Further, the deviation in the transport direction between the first line pattern 111*a* and the second line pattern 112*a* is more increased at the overlapped portion 121*a* separated farther from the [(N+1)/2]th overlapped portion 121*a*.

On the other hand, as shown in FIG. 6C, in a case that the arrangement direction of the nozzles 10 is inclined with respect to the transport direction, the nozzle 10 used to print the first line pattern 111*a* and the nozzle 10 used to print the second line pattern 112*a* are deviated from each other in the transport direction. In this situation, the larger the inclination of the arrangement direction of the nozzles 10 with respect to the transport direction is, the larger the deviation amount of the nozzle 10 is. Further, in the first embodiment, the first line pattern 111*a* and the second line pattern 112*a* are printed by using the nozzles 10 for forming the two nozzle arrays 9 separated farthest from each other in the scanning direction, of the four nozzle arrays 9. Therefore, the deviation amount of the nozzle 10 is maximized.

Therefore, in this case, as shown in FIG. 6D, the degree of overlap between the first line pattern 111*a* and the second line pattern 112*a* is maximized at any overlapped portion 121*a* other than the [(N+1)/2]th overlapped portion. In this situation, when the inclination of the arrangement direction of the nozzles 10 with respect to the transport direction is more increased, the degree of overlap is maximized between the first line pattern 111*a* and the second line pattern 112*a* at the overlapped portion 121*a* separated from the [(N+1)/2]th overlapped portion 121*a*. That is, in the case of the inspection pattern 100, the extent of the inclination of the arrangement direction of the nozzles 10 with respect to the transport direction is indicated by at what overlapped portion 121*a* the degree of overlap is maximized between the first line pattern 111*a* and the second line pattern 112*a*.

On the other hand, in the overlapped portion 121*a*, the larger the degree of overlap between the first line pattern 111*a* and the second line pattern 112*a* is, the larger the areal size of the white background portion at which the recording paper P is exposed is, wherein the white background portion is formed between the first line pattern 111*a* and the second line pattern 112*a*.

Further, in the first embodiment, the first line pattern 111*a* is printed with the black ink, and the second line pattern 112*a* is printed with the magenta ink. However, the black ink is deeper or darker than the inks of the other colors. Therefore, the portion, at which the first line pattern 111*a* and the second line pattern 112*a* are overlapped with each other, has the color which is close to the color of black. In the case of the brightness value conversion of the color density by the scanner, even when a pattern, in which the black ink is overlapped twice, is read, the brightness value does not become a half. Therefore, the brightness read by the read unit 5 is approximately identical between the portion in which only the first line pattern 111*a* formed with the black ink is arranged and the portion in which the first line pattern 111*a* printed with the black ink and the second line pattern 112*a* printed with the magenta ink are overlapped with each other.

When both of the first line pattern 111*a* and the second line pattern 112*a* are printed with the color ink or color inks, such a situation may also arise that the density is higher at the portion in which the first line pattern 111*a* and the second line pattern 112*a* are overlapped with each other as compared with the portion in which the first line pattern 111*a* or the second line pattern 112*a* is arranged singly. In other words, it is feared that the density fluctuation or the density variation of the overlapped pattern portion 121 does not indicate the fluctuation of the degree of overlap between the first line pattern 111*a* and the second line pattern 112*a*. In this case, whether or not the density fluctuation of the overlapped pattern portion 121 indicates the fluctuation of the degree of overlap between the first line pattern 111*a* and the second line pattern 112*a* changes depending on the way of adjustment in which to what extent of the brightness the minimum value and the maximum value of the brightness value outputted by the read unit 5 are allowed to correspond. Therefore, for example, it is considered that the scanner is set so that the pattern in which the yellow is used singly and the pattern in which the yellow and the cyan are overlapped with each other have substantially the same brightness value. In this case, when the first line pattern 111*a* is printed with the yellow ink and the second line pattern 112*a* is printed with the cyan ink, then the density fluctuation of the overlapped pattern portion 121 indicates the degree of overlap between the first line pattern 111*a* and the second line pattern 112*a*. However, in general, when the adjustment is performed such that the brightness values, which are different from each other as much as possible, are allowed to correspond to the white portion and the black portion, any delicate color difference can be detected at a high resolution in a wide density range. Therefore, the procedure, in which any one of the first line pattern 111*a* and the second line pattern 112*a* is printed with the black ink, is advantageous in relation to the detection accuracy in the read unit 5 described above.

As described above, the larger the degree of overlap between the first line pattern 111*a* and the second line pattern 112*a* at the overlapped portion 121*a* is, the higher the brightness read by the read unit 5 is. That is, the brightness of the overlapped portion 121*a* indicates the degree of overlap between the first line pattern 111*a* and the second line pattern 112*a*. Therefore, when the position of the overlapped portion 121*a*, at which the brightness read by the read unit 5 is the highest (local maximum), is specified, it is possible to acquire the position of the overlapped portion 121*a* at which the degree of overlap between the first line pattern 111*a* and the second line pattern 112*a* is the largest. Further, the inclination of the arrangement direction of the nozzles 10 with respect to the transport direction can be detected from the specified position of the overlapped portion 121*a*.

However, in the first embodiment, the nozzles 10, which are used to print the first line pattern 111*a*, differ depending on every first-partial pattern 111. Therefore, a part of the first line pattern 111*a* is not printed in some cases, for example, due to the clog-up of the nozzle 10, and/or the dispersion arises in the thickness (length in the transport direction) of the first line pattern 111*a* in other cases due to the dispersion of the ink discharge speed and/or the volume. Similarly, a part of the second line pattern 112*a* is not printed in some cases, and/or the dispersion arises in the thickness of the second line pattern 112*a* in other cases. That is, any abnormality sometimes arises in parts of the line patterns 111*a*, 112*a*.

In such situations, it is feared that the brightness of a part of the overlapped portion 121*a* may differ from the brightness to be originally obtained. Accordingly, in the first embodiment, the brightness of each of the areas 131 of the overlapped pattern portion 121 is corrected by subtracting the brightness of the corresponding areas 132, 133 of the single pattern portions 122, 123 from the brightness of each of the areas 131 of the overlapped pattern portion 121 as described above. Thus, the position of the overlapped portion 121*a* having the highest brightness is specified by using the brightness of each of the areas 131 of the overlapped pattern portion 121 after the correction. Further, the inclination of the arrangement direction of the nozzles 10 with respect to the transport direction is detected from the specified position of the overlapped portion 121*a*. Further, the direction of the carriage 11 is adjusted in accordance with the detected inclination so that the arrangement direction of the nozzles 10 is parallel to the transport direction.

Figure 7:
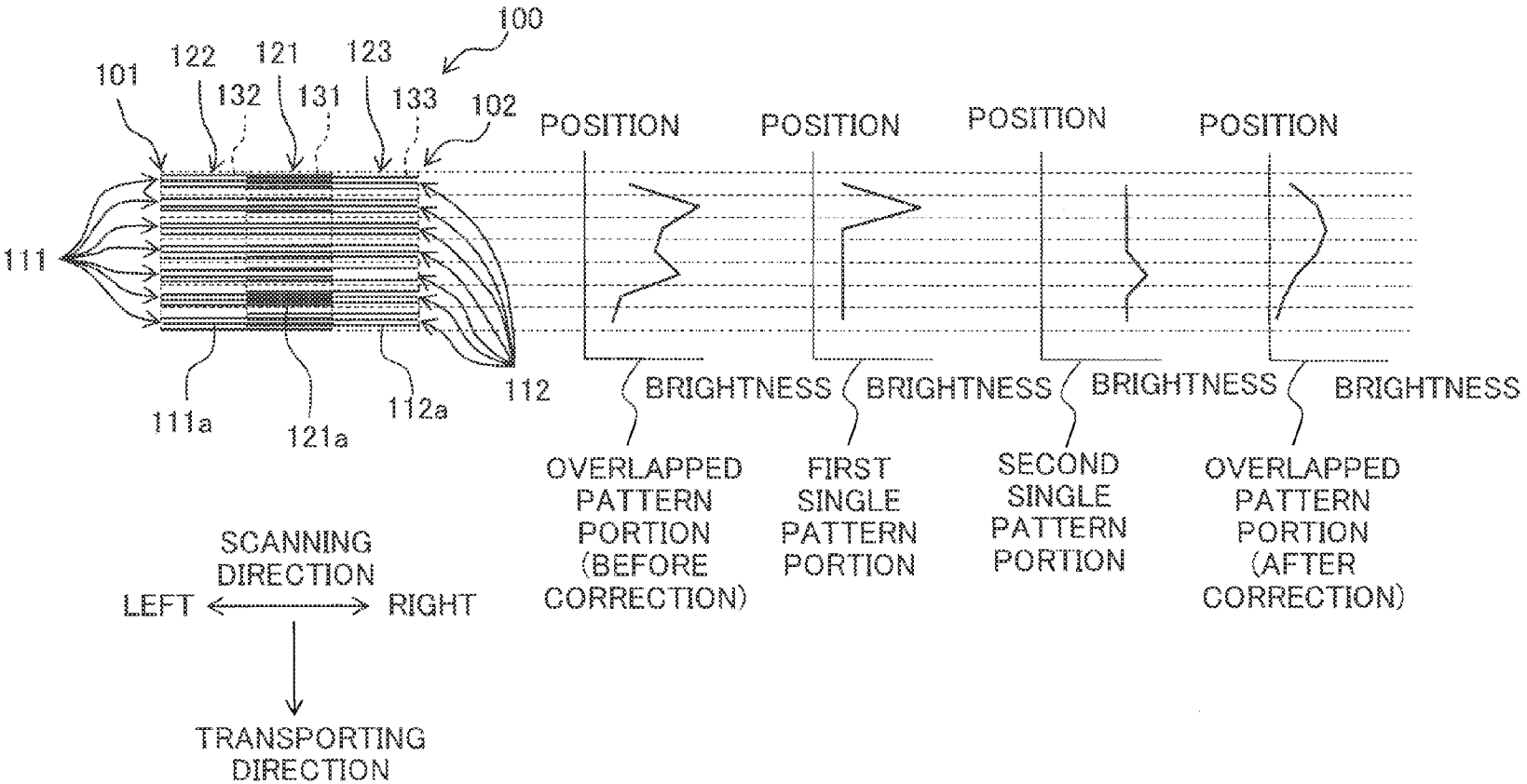
FIG. 7 illustrates the correction of the density of the inspection pattern in the first embodiment.

As shown in FIG. 7, consideration is made while it is assumed by way of example that the brightness is the highest at the fifth overlapped portion 121*a* when no abnormality arises in the line patterns 111*a*, 112*a* on account of the inclination of the arrangement direction of the nozzles 10 with respect to the transport direction. On this assumption, an explanation will be made about a case in which a part of the first line pattern 111*a* of the sixth overlapped portion 121*a* and a part of the second line pattern 112*a* of the third overlapped portion 121*a* are not printed. In this case, at the sixth overlapped portion 121*a*, the portion, at which the recording paper P is exposed, has the increased areal size to such an extent that the part of the first line pattern 111*a* is not printed, and the acquired brightness is raised. Further, at the fifth overlapped portion 121*a*, the portion, at which the recording paper P is exposed, has the increased areal size to such an extent that the part of the second line pattern 112*a* is not printed, and the acquired brightness is raised. The brightness of the fifth overlapped portion 121*a* is to be originally the highest in relation to the overlapped pattern portion 121. However, if the correction as described above is not performed, the brightness of the third or sixth overlapped portion 121*a* is the highest.

On the other hand, as for the first single pattern portion 122, the brightness of the sixth first-partial pattern 111 is higher than the brightness of the other first-partial patterns 111. As for the second single pattern portion 123, the brightness of the third second-partial pattern 112 is higher than the brightness of the other second-partial patterns 112. Therefore, if the brightness of the overlapped pattern portion 121 is corrected by subtracting the brightness of the single pattern portions 122, 123 from the brightness of the overlapped pattern portion 121, the relationship of magnitude of the brightness after the correction, which is provided between the N pieces of overlapped portions 121*a* in the overlapped pattern portion 121 after the correction, is the same as the relationship of magnitude of the brightness which is provided between the N pieces of overlapped portions 121*a* when any abnormality does not arise in the line patterns 111*a*, 112*a*. That is, when any abnormality arises in a part or parts of the first-pattern 101 and the second-pattern 102, the influence of the brightness change caused by the abnormality can be excluded from the brightness of the overlapped pattern portion 121.

In the first embodiment, the nozzles 10, which form the different nozzle arrays 9, are used in relation to the printing of the first line pattern 111*a* and the printing of the second line pattern 112*a*. That is, the nozzles 10 to be used differ between the printing of the first line pattern 111*a* and the printing of the second line pattern 112*a*. Therefore, the probability is raised in relation to the occurrence of abnormality in the nozzles 10 when the first line pattern 111*a* and the second line pattern 112*a* are printed, as compared with a case in which the first line pattern and the second line pattern are printed by using the same nozzles 10 (for example, a case in which an inspection pattern 300 is printed in a third embodiment described later on). Therefore, there is a great significance in the correction of the brightness of the overlapped pattern portion 121 with the brightness of the single pattern portions 122, 123 as described above.

Second Embodiment

Next, an explanation will be made about a second embodiment of the present teaching. However, components or parts different from those of the first embodiment will be principally explained below.

In the print unit 2 described above, the transporting rollers 13 transport the recording paper P in the transport direction. However, the transport amount of the recording paper P is determined by the rotation amount and the diameter of the transporting roller 13. On the other hand, in the print unit 2, as described above, the printing is performed on the recording paper P by discharging the inks from the ink-jet head 12, while intermittently transporting the recording paper P in the transport direction by means of the transporting rollers 13. In this procedure, the ideal transport amount L of the recording paper P to be provided by performing the transport operation once is determined by the length C of the nozzle array 9 in the transport direction (see FIG. 2). In the following explanation, the ideal transport amount L to be provided by performing the transport operation once is defined as the amount obtained by subtracting the length F in the transport direction of the range of arrangement of the nozzles 10 used to print each of partial patterns 211, 212 from the length C of the nozzle array 9. There is no need to define the ideal transport amount L, in the above-described way. However, it is preferable to define the ideal transport amount L in the above-described way, because it is possible to maximize the value of L.

In this procedure, in the case of the printer 1, any dispersion arises in the actual diameter of the transporting roller 13 and/or the length C of the nozzle array 9, for example, due to the influence of the error caused during the production. Therefore, if the rotation amount of the transporting roller 13, which is to be provided when the recording paper P is transported during the printing, is determined assuming that the diameter of the transporting roller 13 and the length C of the nozzle array 9 are the designed values, then it is feared that the transport amount of the recording paper P is not the adequate transport amount with respect to the length C of the nozzle array 9, and the quality of the printing may be deteriorated. Accordingly, in the second embodiment, the following inspection is performed at the stage at which the production of the printer 1 is completed, and the rotation amount of the transporting roller 13 is corrected when the recording paper P is transported during the printing.

Figure 8A:
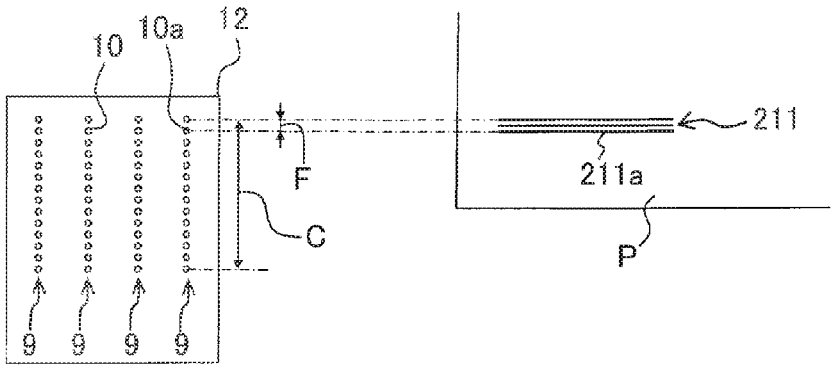
FIGS. 8A, 8B and 8C show steps illustrating a printing procedure for an inspection pattern (pattern for inspection) in a second embodiment.
Figure 9A:
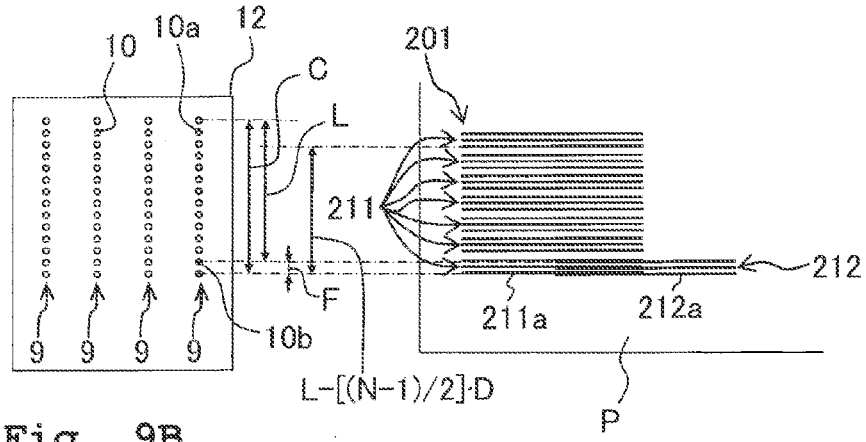
FIGS. 9A, 9B and 9C show steps to be performed after those shown in FIGS. 8A to 8C, of the printing procedure for the inspection pattern in the second embodiment.
Figure 9B:
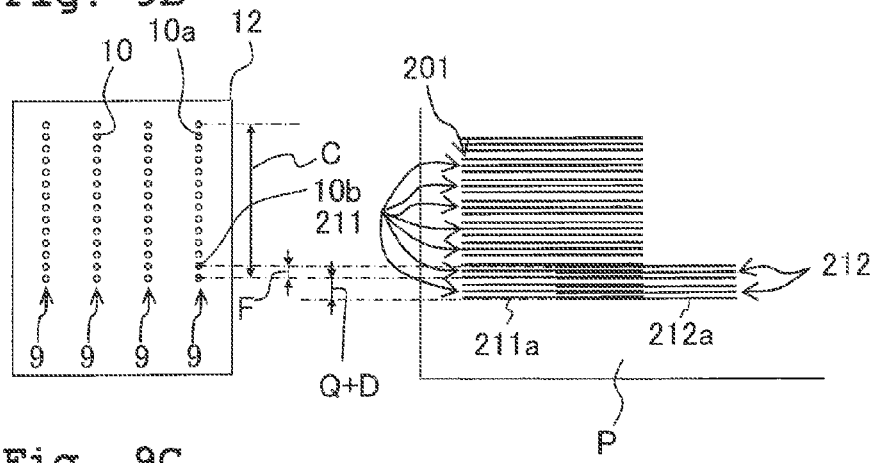
Figure 9C:
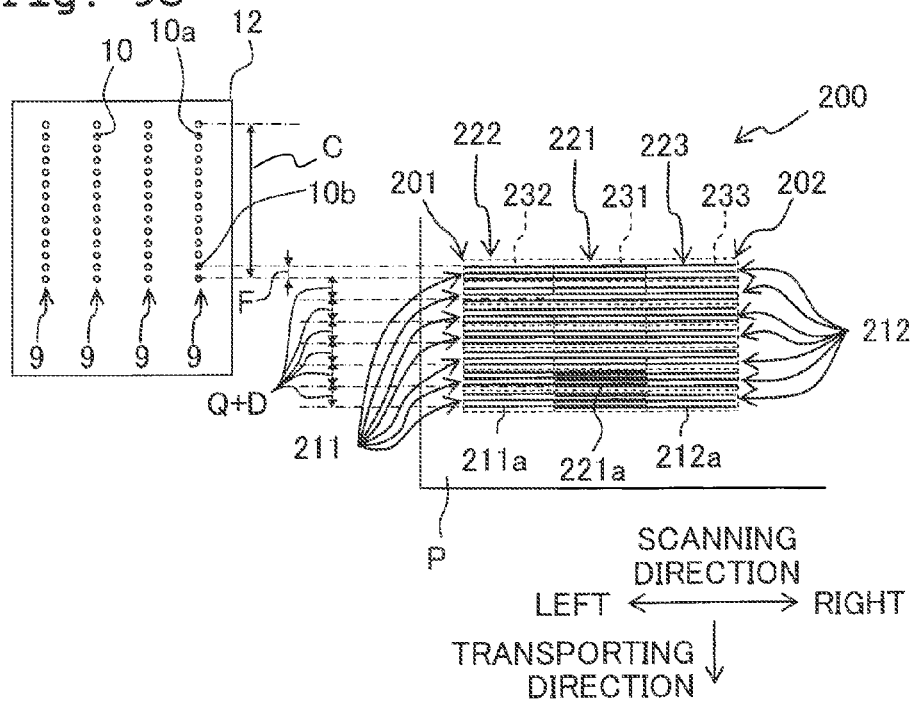

Specifically, an inspection pattern (a pattern for inspection) 200 as shown in FIG. 9C is firstly printed. A printing procedure for printing the inspection pattern 200 will be explained. At first, as shown in FIG. 8A, the black ink is discharged from M pieces of the nozzles 10*a* disposed on the upstream side in the transport direction, of the nozzles 10 for forming the nozzle array 9 positioned on the rightmost side, and thus a first-partial pattern 211, which is composed of M pieces of first line patterns 211*a*, is printed on the recording paper P. The M pieces of first line patterns 211*a* extend in the scanning direction respectively, and they are arranged at equal intervals in the transport direction.

Figure 8B:
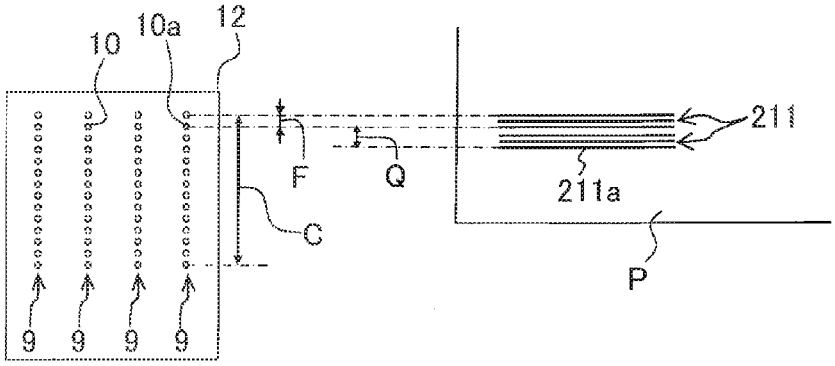
Figure 8C:
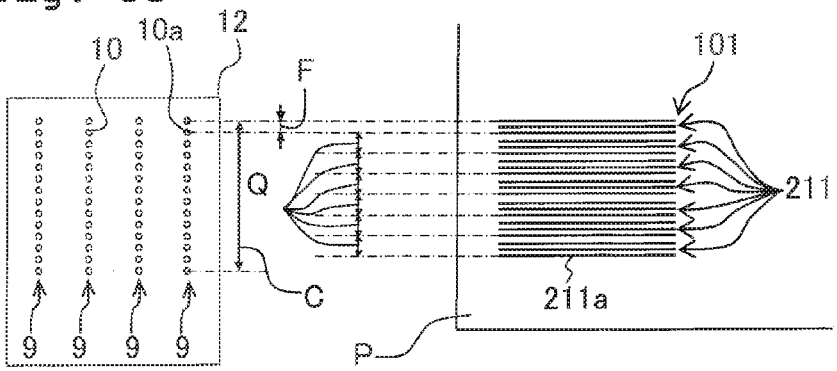
Figure 8C:
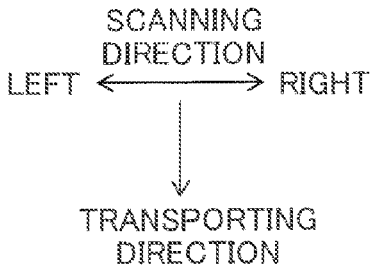

Subsequently, as shown in FIG. 8B, the recording paper P is transported by a predetermined distance Q by means of the transporting rollers 13, and then the black ink is discharged from the M pieces of nozzles 10*a* described above to print the first-partial pattern 211. After that, the transport of the recording paper P by the transporting rollers 13 and the printing of the first-partial pattern 211 are repeatedly performed to thereby print a first-pattern 201 formed by aligning N pieces of the first-partial patterns 211 in the transport direction as shown in FIG. 8C.

Subsequently, as shown in FIG. 9A, the black ink is discharged from M pieces of the nozzles 10*b* separated from the nozzles 10*a* by L on the downstream side in the transport direction. In this way, a second-partial pattern 212, which is composed of M pieces of second line patterns 212*a*, is printed. In this case, before printing the second-partial pattern 212, the recording paper P is transported by the transporting rollers 13 to a position at which the accumulated or added-up transport amount is $L-[(N-1)/2]\times D$ from the position at which the first first-pattern 201 is printed. In the first embodiment, the recording paper P has already been transported by a length of $(N-1)\times Q$ during the period in which the first-pattern 201 is printed. Therefore, the transport amount of the recording paper P which is to be transported after printing the first-pattern 210 is $L-[(N-1)/2]\times D-(N-1)\times Q$. In this case, D is a minute value as compared with L (for example, D=L/100). The M pieces of second line patterns 212*a* extend in the scanning direction respectively, and they are arranged at equal intervals in the transport direction. In this procedure, the second line pattern 212*a* is printed while deviating the second line pattern 212*a* with respect to the first line pattern 211*a* on the right side in the scanning direction by an amount shorter than the length in the scanning direction of the line patterns 211*a*, 212*a*.

Subsequently, as shown in FIG. 9B, the recording paper P is transported by (Q+D) by the transporting rollers 13, and the black ink is discharged from the M pieces of nozzles 10*b* described above to print the second-partial pattern 212. In the following procedure, the transport of the recording paper P by the transporting rollers 13 and the printing of the second-partial pattern 212 are repeatedly performed. Accordingly, as shown in FIG. 9C, a second-pattern 202, in which N blocks of the second-partial patterns 212 are aligned in the transport direction, is printed.

The first-pattern 201 and the second-pattern 202 are printed as described above. Accordingly, the inspection pattern 200, which is composed of the first-pattern 201 and the second-pattern 202, is printed on the recording paper P. The inspection pattern 200 has an overlapped pattern portion 221, a first single pattern portion 222, and a second single pattern portion 223.

The overlapped pattern portion 221 is the portion which is positioned at a substantially central portion of the inspection pattern 200 in the scanning direction and at which the first-pattern 201 and the second-pattern 202 are overlapped with each other. In the overlapped pattern portion 221, the first-partial pattern 211, which is provided at the K-th position (K=1, 2, . . . N), is overlapped with the K-th second-partial pattern 212. The following explanation will be made assuming that the portion of the overlapped pattern portion 221, at which the K-th first-partial pattern 211 and the K-th second-partial pattern 212 are overlapped with each other, is referred to as "K-th overlapped portion 221*a*".

The first single pattern portion 222 is the portion which is positioned on the left side in the scanning direction of the overlapped pattern portion 221 and which is formed with only the first-pattern 201. The second single pattern portion 223 is the portion which is positioned on the right side in the scanning direction of the overlapped pattern portion 221 and which is formed with only the second-pattern 202.

Subsequently, the printed inspection pattern 200 is read by the read unit 5 to thereby acquire the brightness (density information of the present teaching) of the respective portions of the overlapped pattern portion 221 and the single pattern portions 222, 223 (a step of reading of the present teaching). Specifically, the overlapped pattern portion 221 is comparted into a plurality of areas 231 in each of which only one overlapped portion 2211*a* is arranged, and the brightness of the respective areas 231 are acquired. Further, the first single pattern portion 222 is comparted into a plurality of areas 232 in each of which only one first-partial pattern 111 is arranged, and the brightness of the respective areas 232 are acquired. Further, the second single pattern portion 223 is comparted into a plurality of areas 233 in each of which only one second-partial pattern 212 is arranged, and the brightness of the respective areas 233 are acquired.

Subsequently, the brightness of each of the areas 231 of the overlapped pattern portion 221 is corrected by subtracting the brightness of the corresponding areas 232, 233 of the single pattern portions 222, 223 from the brightness of each of the areas 231 of the overlapped pattern portion 221 (a step of acquiring density of the present teaching). Subsequently, the area 231 having the highest brightness is specified on the basis of the density of each of the areas 231 of the overlapped pattern portion 221 after the correction. Thus, the position in the transport direction is specified for the overlapped portion 221*a* which has the largest degree of overlap between the first line pattern 211*a* and the second line pattern 212*a* (a step of specifying position of the present teaching). Further, the rotation amount of the transporting roller 13 during the printing is adjusted on the basis of the position of the specified overlapped portion 221*a*.

This procedure will be explained in further detail below. When the diameter of the transporting roller 13 and the length C of the nozzle array 9 are exactly the designed values, the transport distance of the recording paper P, which is provided from the printing position of the K-th first-partial pattern 211 to the printing position of the K-th second-partial pattern 212, is $L-[(N+1)/2]\times D+K\times D$. Therefore, when $K=[(N+1)/2]$ is given, the transport distance of the recording paper P, which is provided from the position of printing of the first-partial pattern 211 to the position of printing of the second-partial pattern 212, is L. When the length C of the nozzle array 9 is exactly the designed value, then L is the amount obtained by subtracting, from the length C of the nozzle array 9, the length F in the transport direction of the range of arrangement of the nozzles 10 used to print the respective partial patterns 211, 212, and hence the first line pattern 211*a* and the second line pattern 212*a* are overlapped with each other substantially completely at the [(N+1)/2]th overlapped portion 221*a*. Further, the deviation in the transport direction between the first line pattern 211*a* and the second line pattern 212*a* is more increased for the overlapped portion 221*a* separated farther in the transport direction from the [(N+1)/2]th overlapped portion 221*a*.

On the other hand, when the diameter of the transporting roller 13 and/or the length C of the nozzle array 9 is/are deviated from the designed value or designed values, the degree of overlap between the first line pattern 211*a* and the second line pattern 212*a* is maximized at any overlapped portion 221*a* other than the [(N+1)/2]th overlapped portion 221*a* depending on the deviation amount from the designed value.

Therefore, in the second embodiment, the position of the overlapped portion 221*a*, at which the degree of overlap between the first line pattern 211*a* and the second line pattern 212*a* is maximized, indicates the transport amount of the recording paper P (rotation amount of the transporting roller 13) which is adequate with respect to the length C of the nozzle array 9.

Also in the second embodiment, the larger the degree of overlap between the first line pattern 211*a* and the second line pattern 212*a* is, the higher the brightness read by the read unit 5 is, in the same manner as explained in the first embodiment. Therefore, the position of the overlapped portion 221*a*, at which the degree of overlap between the first line pattern 211*a* and the second line pattern 212*a* is maximized, can be acquired by acquiring the position of the overlapped portion 221*a* at which the brightness is the highest. The brightness of the overlapped pattern portion 221 is changed in the same manner as those shown in FIGS. 6B and 6D, any illustration in the drawing is omitted herein.

However, when the inspection pattern 200 is printed as well, then parts of the line patterns 211*a*, 212*a* are not printed in some cases, and/or the dispersion arises in the thicknesses of the line patterns 211*a*, 212*a* in other cases. For example, in the case of the second embodiment, when the inspection pattern 200 is printed with the printer 1 with which the printing has not been performed for a long period, the following situation tends to arise due to the increase in viscosity of the ink. That is, the ink is not discharged from the nozzles 10*a* in some cases and/or the volume of the ink discharged from the nozzles 10*a* is decreased in other cases, when the first-partial pattern 211 to be printed firstly is printed as compared with when the first-partial pattern 211 to be printed secondly or following times is printed. Similarly, the following situation tends to arise. That is, the ink is not discharged from the nozzles 10*b* in some cases and/or the volume of the ink discharged from the nozzles 10*b* is decreased in other cases, when the second-partial pattern 212 to be printed firstly is printed as compared with when the second-partial pattern 212 to be printed secondly or following times is printed. In such situations, it is feared that the brightness of a part of the overlapped portion 221*a* may differ from the brightness to be originally obtained at the overlapped pattern portion 221.

Accordingly, in the second embodiment, as described above, the brightness of the overlapped pattern portion 221 is corrected by subtracting the brightness of corresponding areas 232, 233 of the single pattern portions 222, 223 from the brightness of each of the areas 231 of the overlapped pattern portion 221. Further, the position of the overlapped portion 221*a* having the lowest brightness is specified by using the brightness of each of the areas 231 of the overlapped pattern portion 221 after the correction. Further, the rotation amount of the transporting roller 13 is adjusted on the basis of the position of the specified overlapped portion 221*a*.

Figure 10:
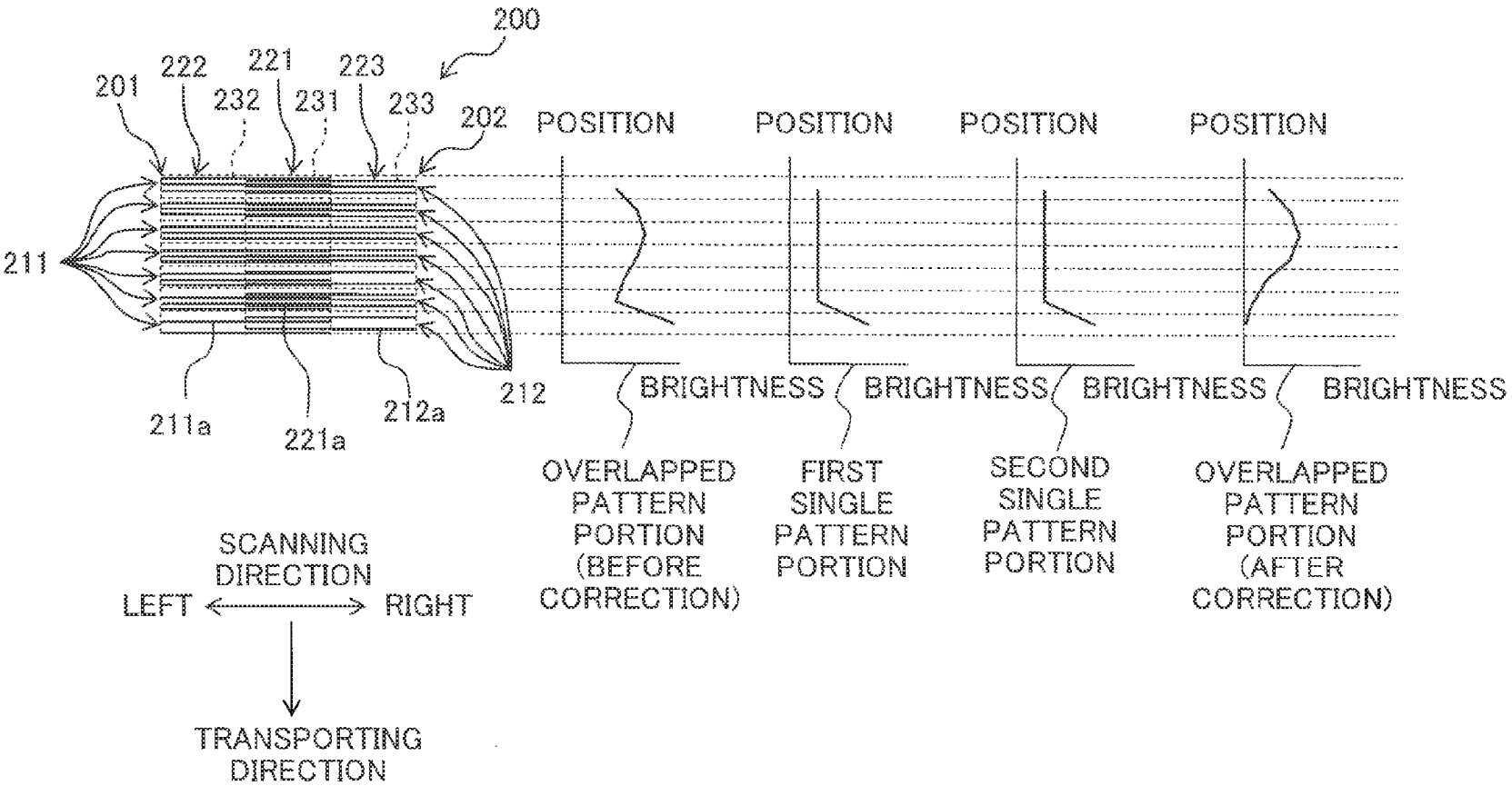
FIG. 10 illustrates the correction of the density of the inspection pattern in the second embodiment.

As shown in FIG. 10, consideration is made while it is assumed that the brightness is the highest at the fifth overlapped portion 221*a* if no abnormality arises in the line patterns 211*a*, 212*a* on account of the deviation of the diameter of the transporting roller 13 and/or the length C of the nozzle array 9 from the designed value or designed values. On this assumption, an explanation will be made about a case in which a part of the first line pattern 211*a* of the first first-partial pattern 211 is not printed and a part of the second line pattern 212*a* of the first second-partial pattern 212 is not printed. In this case, the brightness of the fifth overlapped portion 221*a* is to be originally the highest in relation to the overlapped pattern portion 221. However, at the first overlapped portion 221*a*, the part of the first line pattern 211*a* and the part of the second line pattern 212*a* are not printed. Therefore, the brightness is the highest at the first overlapped portion 221*a*.

On the other hand, as for the first single pattern portion 222, the brightness of the first first-partial pattern 211 is higher than those of the other first-partial patterns 211. As for the second single pattern portion 223, the brightness of the first second-partial pattern 212 is higher than those of the other second-partial patterns 212. Therefore, if the brightness of the overlapped pattern portion 221 is corrected by subtracting the brightness of the single pattern portions 222, 223 from the brightness of the overlapped pattern portion 221, the relationship of magnitude of the brightness after the correction, which is provided between the N blocks of overlapped portions 221*a* in the overlapped pattern portion 221, is the same as the relationship of magnitude of the brightness which is provided between the N pieces of overlapped portions 221*a* when any abnormality does not arise in all of the line patterns 211*a*, 212*a*. That is, when any abnormality arises in parts of the first-pattern 201 and the second-pattern 202, the influence of the brightness change caused by the abnormality can be excluded from the information of the brightness of the overlapped pattern portion 221.

In the second embodiment, the nozzles 10*a* to be used for the printing of the first line pattern 211*a* is different from the nozzles 10*b* to be used for the printing of the second line pattern 212*a*. Therefore, the probability is raised in relation to the occurrence of abnormality in the nozzles 10 when the first line pattern 211*a* and the second line pattern 212*a* are printed, as compared with a case in which the first line pattern and the second line pattern are printed by using the same nozzles 10 (for example, a case in which an inspection pattern 300 is printed in a third embodiment described later on). Therefore, there is a great significance in the correction of the brightness of the overlapped pattern portion 221 with the brightness of the single pattern portions 222, 223 as described above.

Third Embodiment

Next, an explanation will be made about a third embodiment of the present teaching. However, components or parts different from those of the first and second embodiments will be principally explained below.

Figure 11:
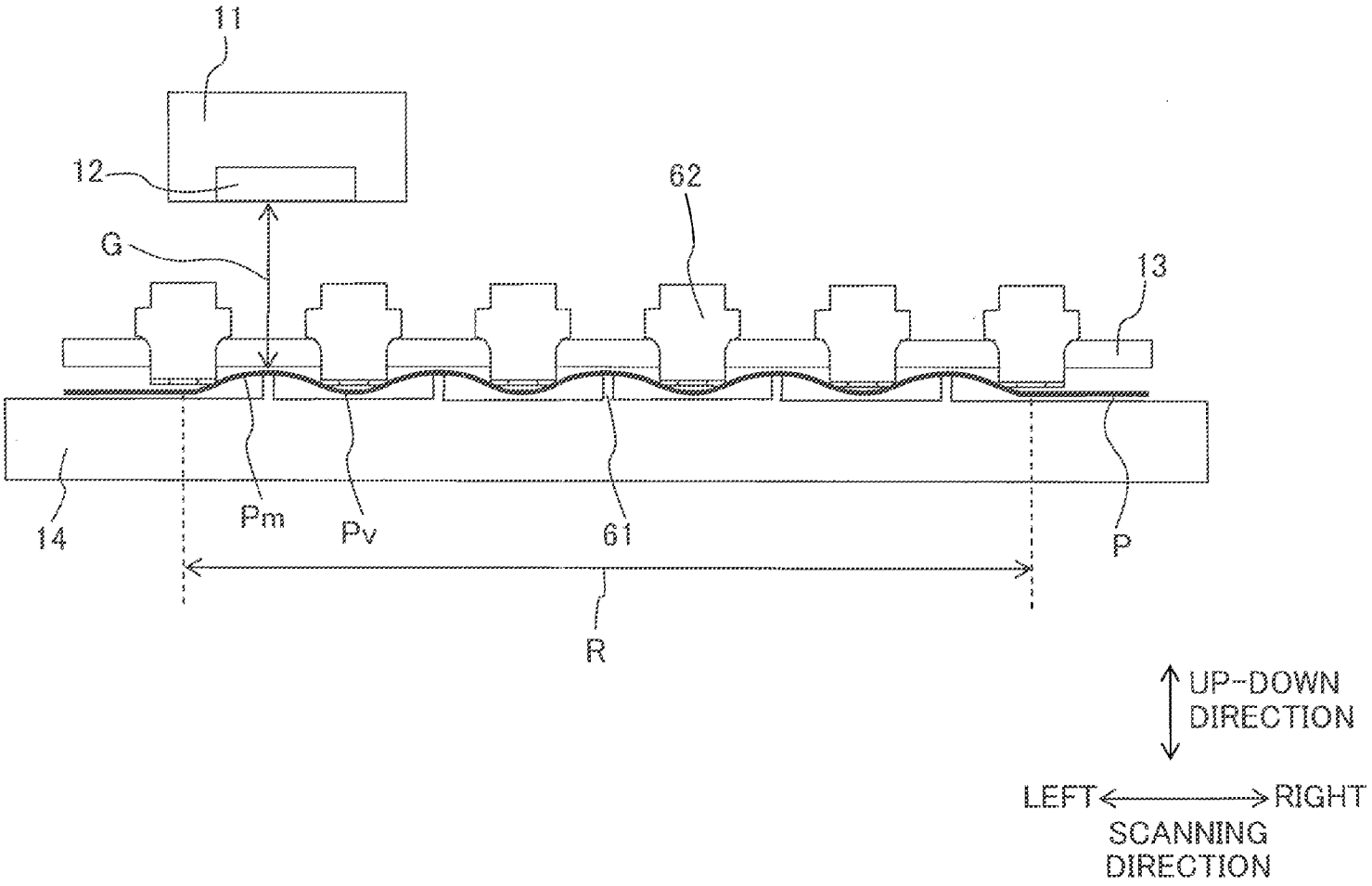
FIG. 11 shows an arrangement of a platen and holding members in a third embodiment.

In the third embodiment, as shown in FIG. 11A, a plurality of ribs 61 are arranged on the upper surface of a platen 14 while providing intervals in the scanning direction. A plurality of holding members 62, which hold the recording paper P from upper positions, are arranged at portions positioned between the plurality of ribs 61 in the scanning direction. The holding members 62 are retained by, for example, an unillustrated frame of the printer 1. Accordingly, the recording paper P, which is transported by the transporting rollers 13, is bent by the plurality of ribs 61 and the plurality of holding members 62 to provide such a wavy shape that peak portions Pm protruding upwardly and valley portions Pv protruding downwardly are alternately aligned in the scanning direction in a range R from which the both ends portions in the scanning direction are excluded. Accordingly, the distance G, which is provided between the nozzle 10 of the ink-jet head 12 and the recording paper P having the wavy shape, varies or fluctuates in the scanning direction.

In this arrangement, in the print unit 2, the printing is performed by discharging the inks from the nozzles 10 while reciprocatively moving the carriage 11 in the scanning direction as described above. In this case, in order that any deviation does not arise in the landing position of the ink on the recording paper P between when the carriage 11 is moved to the right side in the scanning direction and when the carriage 11 is moved to the left side, it is necessary to adjust the discharge timing of the ink from the nozzle 10. The amount of movement of the ink in the scanning direction, which is provided until the ink is landed on the recording paper P after the ink is discharged from the nozzle 10, is increased/decreased depending on the flight time of the ink. Therefore, the discharge timing of the ink from the nozzle 10, which is required to land the ink onto a certain position of the recording paper P, differs depending on the distance between the nozzle 10 and the recording paper P. In the third embodiment, as described above, the distance between the nozzle 10 and the recording paper P varies in the scanning direction. Therefore, in order to determine the discharge timing of the ink to be discharged from the nozzle 10, it is necessary to acquire the distance between the nozzle 10 and each of the portions of the recording paper P. Accordingly, in the third embodiment, the inspection is performed as follows. The distance between the nozzle 10 and each of the portions of the recording paper P is acquired depending on the inspection result. Further, the discharge timing of the ink to be discharged from the nozzle 10 is adjusted depending on the acquired distance.

Figure 12A:
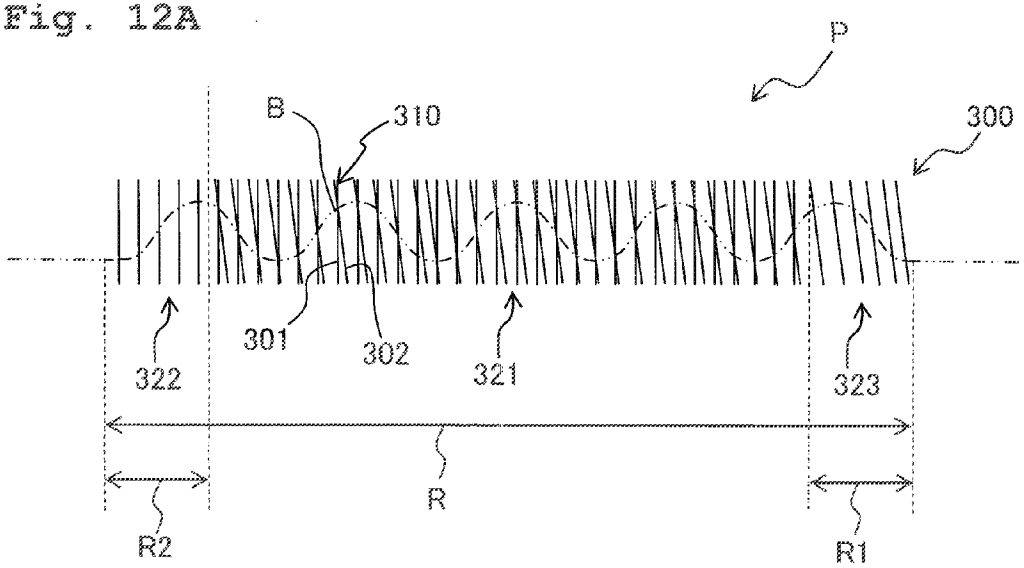
FIG. 12A shows an inspection pattern (pattern for inspection) in the third embodiment.
Figure 13:
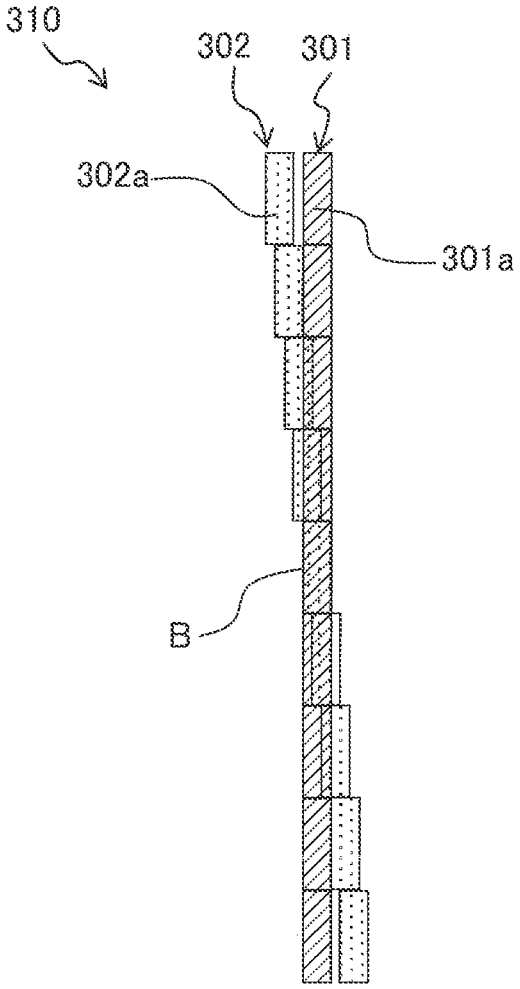
FIG. 13 shows enlarged first and second-patterns in the third embodiment.

Specifically, at first, an inspection pattern 300 as shown in FIG. 12A is printed. The printing procedure for printing the inspection pattern 300 will be explained. The black ink is discharged from the plurality of nozzles 10 for forming a certain nozzle array 9 (see FIG. 1) while moving the carriage 11 to the right side in the scanning direction to thereby print a plurality of first-patterns 301 arranged in the scanning direction. The first-pattern 301 is the pattern which extends linearly or in a straight line form in parallel to the transport direction. In particular, as shown in FIG. 13, the first-pattern 301 is the pattern formed such that a plurality of linear first line patterns 301*a* each having a short length, which extend in parallel to the transport direction, are arranged in the transport direction. However, in FIG. 13, in order to illustrate the drawing simply, the first line pattern 301*a* and a second line pattern 302*a* are shown more thickly as compared with the actual dimensions. Further, the plurality of first-patterns 301 are printed over a range from which a range R1 positioned at the right end portion is excluded, the range being included in the range R in which the recording paper P has the wavy shape.

Subsequently, the black ink is discharged from the nozzles 10 for forming the nozzle array 9 disposed on the rightmost side, while moving the carriage 11 to the left side in the scanning direction to thereby print a plurality of second-patterns 302 which are arranged in the transport direction. The second-pattern 302 is the step-shaped pattern. However, the difference in level or step of the step-shaped pattern is minute. Therefore, the second-pattern 302 looks like a linear pattern inclined with respect to the transport direction as a whole. In FIG. 12, the second-pattern 302 is expressed as a diagonal line or oblique line. However, in particular, as shown in FIG. 13, the second-pattern 302 is the pattern formed such that the linear second line patterns 302*a* each having a short length, which extend in parallel to the transport direction, are arranged in the transport direction while being deviated from each other in the scanning direction. Further, the second-patterns 302 are printed over a range from which a range R2 positioned at the left end portion is excluded, the range being included in the range R in which the recording paper P has the wavy shape. When the second-pattern 302 is printed, the ink is discharged from the nozzle 10 at such a discharge timing that the point of intersection B between the first-pattern 301 and the second-pattern 302 is disposed at the central portions of the first-pattern 301 and the second-pattern 302, assuming that the distance between the nozzle 10 and the recording paper P is a certain predetermined distance.

The plurality of first-patterns 302 and the plurality of second-patterns 302 are printed as described above, and thus the inspection pattern 300, which includes the plurality of first-patterns 301 and the plurality of second-patterns 302, is printed on the recording paper P. The inspection pattern 300 has an overlapped pattern portion 321, a first single pattern portion 322, and a second single pattern portion 323. The overlapped pattern portion 321 is the portion in which the first-patterns 301 and the second-patterns 302 are overlapped with each other, the portion being positioned in the range of the range R from which the ranges R1, R2 are excluded. Intersecting patterns 310, in each of which the first-pattern 301 and the second-pattern 302 intersect, are formed in the overlapped pattern portion 321. The first single pattern portion 322 is the portion in which only the first-patterns 301 are formed, the portion being positioned in the range R2. The second single pattern portion 323 is the portion in which only the second-patterns 302 are formed, the portion being positioned in the range R1.

Subsequently, the inspection pattern 300 is read by the read unit 50 to thereby acquire the brightness of the respective portions of the inspection pattern (a step of reading the present teaching). This procedure will be explained in further detail below. The overlapped pattern portion 321 is comparted into a plurality of brightness acquiring areas 330 in each of which a predetermined number of the intersecting patterns 310 are included, and the brightness acquiring area 330 is comparted into a plurality of areas 331 which are aligned in the transport direction. Further, the brightness of the respective areas 331 are acquired. Further, each of the single pattern portions 322, 323 is comparted into a plurality of areas 332, 333 which are aligned in the transport direction, and the brightness of the respective areas 332, 333 are acquired.

Subsequently, the brightness of the corresponding areas 332, 333 of the single pattern portions 322, 323 are subtracted from the brightness of the respective areas 331 of the respective brightness acquiring areas 330 to thereby correct the brightness of the respective areas 331 of the respective brightness acquiring areas (a step of acquiring density of the present teaching).

In this procedure, the first line pattern 301*a* and the second line pattern 302*a* are overlapped with each other substantially completely at the point of intersection B between the first-pattern 301 and the second-pattern 302 in the intersecting pattern 310. Further, the first line pattern 301*a* and the second line pattern 302*a* are more deviated from each other in the scanning direction at positions separated farther from the point of intersection B in the transport direction. Accordingly, the thickness of the intersecting pattern 310 is the thinnest at the point of intersection B, and the thickness becomes thicker at positions separated farther from the point of intersection B in the transport direction. Therefore, the brightness of the intersecting pattern 310 is the highest in the area 331 including the point of intersection B, and the brightness is more lowered in the areas 331 separated farther from the point of intersection B in the transport direction. In FIG. 12, in order to illustrate the drawing simply, the inclination of the second line pattern 302*a* with respect to the transport direction is enlarged as compared with the actual dimension, and the first line pattern 301*a* and the second line pattern 302*a* are not overlapped with each other at most portions other then the point of intersection B. However, actually, as shown in FIG. 13, the inclination of the second line pattern 302*a* with respect to the transport direction is such an inclination that at least parts of the first line pattern 301*a* and the second line pattern 302*a* are overlapped with each other at most portions thereof.

On the other hand, in the third embodiment, as described above, the point of intersection B between the first-pattern 301 and the second-pattern 302 is positioned at the central portions thereof when the distance between the nozzle 10 and the recording paper P is the predetermined distance described above. When the distance between the nozzle 10 and the recording paper P is deviated from the predetermined distance, then the formation position of the first-pattern 301 and the formation position of the second-pattern 302 are deviated to the mutually opposite sides in the scanning direction, and thus the point of intersection B is deviated in the transport direction. Therefore, the brightness acquiring area 330, which includes the predetermined number of intersecting patterns 310, has the brightness which is the highest at the position obtained by averaging the positions of the points of intersection B in the intersecting patterns 310. In this case, to what side the point of intersection B is deviated in the transport direction is determined whether the distance between the nozzle 10 and the recording paper P is larger or smaller than the predetermined distance. Further, the deviation amount of the point of intersection B is determined by the difference of the distance between the nozzle 10 and the recording paper P from the predetermined distance, the inclination of the second-pattern 302, the movement speed of the carriage 11, and the flight speed of the ink discharged from the nozzle 10. On the other hand, the inclination of the second-pattern 302, the movement speed of the carriage 11, and the flight speed of the ink discharged from the nozzle 10 are controlled by known quantities or amounts. Therefore, the deviation amount of the point of intersection B is the amount corresponding to the distance between the nozzle 10 and the recording paper P.

According to the fact as described above, in the third embodiment, the position, at which the brightness of each of the brightness acquiring areas 330 is the highest, indicates the distance between the nozzle 10 and the portion of the recording paper P corresponding to each of the brightness acquiring areas 330.

Figure 12B:
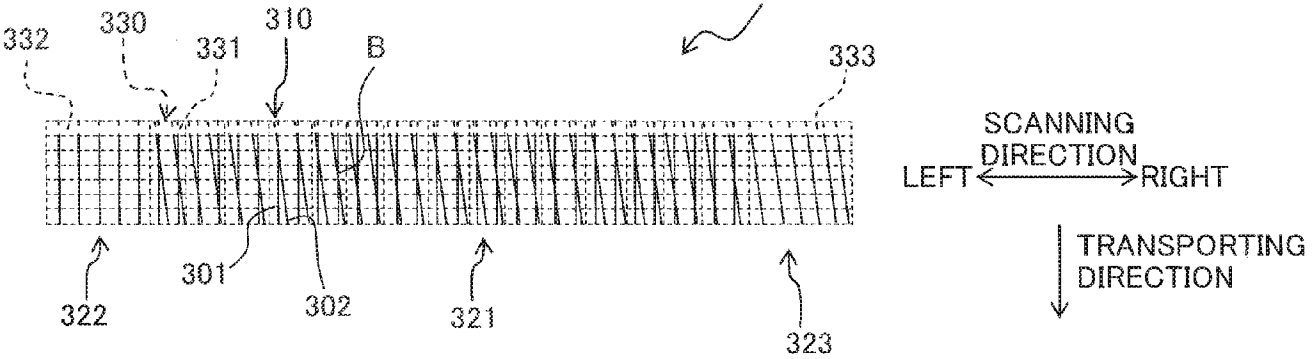
FIG. 12B shows a printing result of the inspection pattern when a part of line pattern is not printed.

However, in the third embodiment, the plurality of first line patterns 301*a*, which form the first-patterns 301, are printed by the ink discharged from the different nozzles 10, and the plurality of second line patterns 302*a*, which form the second-patterns 302, are printed by the ink discharged from the different nozzles 10. When the inspection pattern 300 is printed, such a situation may arise that parts of the line patterns 301*a*, 302*a* are not printed as shown in FIG. 12B due to the clog-up of parts of the nozzles 10. On the other hand, the dispersion sometimes arises in the thickness between the line patterns 301*a*, 302*a* due to the increased viscosity of the ink contained in parts of the nozzles 10. In such situations, parts of the acquired brightness of the brightness acquiring areas 330 are different from the brightness to be originally obtained.

Accordingly, in the third embodiment, as described above, the brightness of the respective portions of the respective brightness acquiring areas 330 are corrected by subtracting the brightness of the corresponding area portions 332, 333 of the single pattern portions 322, 323 from the brightness of the respective areas 331 of the respective brightness acquiring areas 330. The position, at which the brightness of each of the brightness acquiring areas 330 is the highest, is specified by using the brightness of the respective brightness acquiring areas 330 after the correction. The distance between the nozzle 10 and the portion of the recording paper P corresponding to each of the brightness acquiring areas is acquired on the basis of the specified position. Accordingly, it is possible to accurately acquire the distance between the nozzle 10 and each of the portions of the recording paper P.

Figure 14:
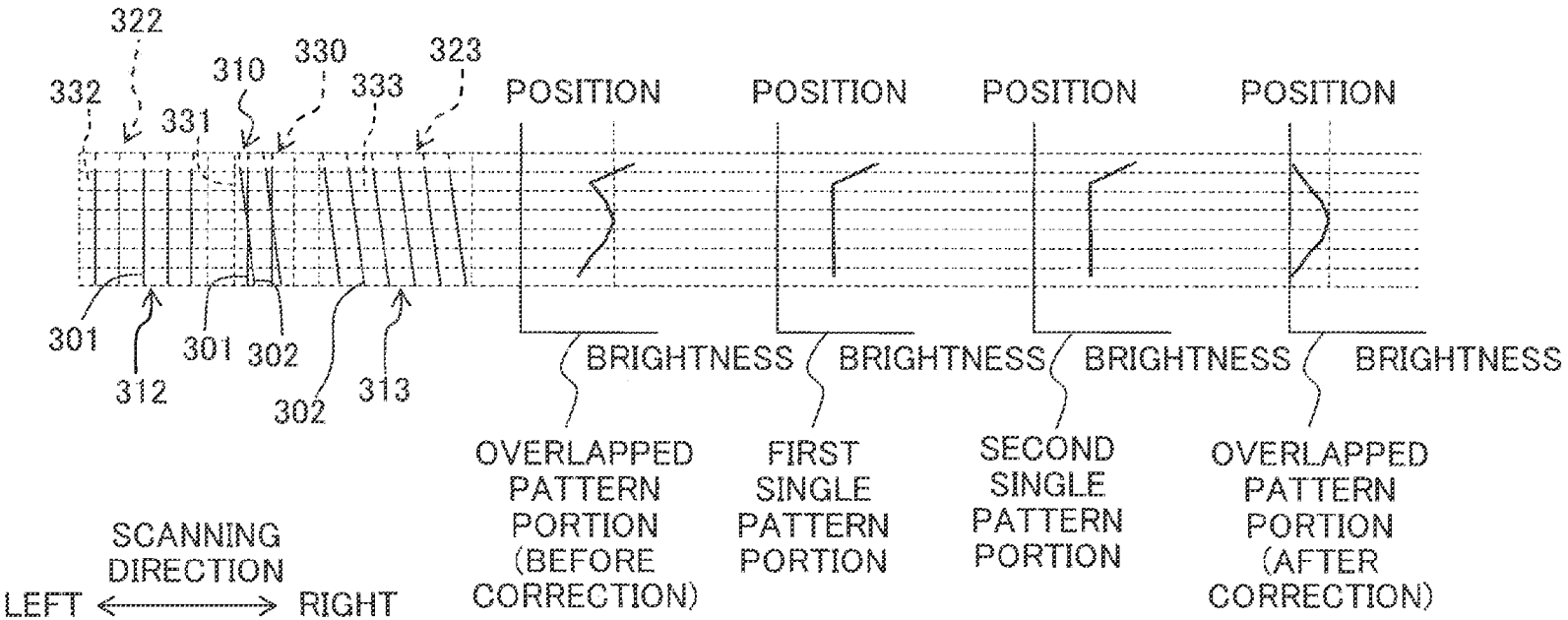
FIG. 14 illustrates the density correction in the brightness acquiring area.

As shown in FIG. 14, consideration is made while it is assumed by way of example that the brightness of a certain brightness acquiring area 330 is originally the highest in the fourth area 331 as counted from the upstream side in the transport direction, in accordance with the relationship of the distance between the nozzle 10 and the portion of the recording paper P corresponding to the concerning brightness acquiring area 330. On this assumption, an explanation will be made about a case in which parts of the line patterns 301*a*, 302*a* arranged in the first areas 332, 333 as counted from the upstream side in the transport direction are not printed. In this case, the brightness is the lowest in the first brightness acquiring area 330 as counted from the upstream side in the transport direction.

On the other hand, in this situation, the brightness of the first single pattern portion 322 is higher than those of the other portions in the first area 332 as counted from the upstream side in the transport direction. Further, the brightness of the second single pattern portion 323 is higher than those of the other portions in the first area 332 as counted from the upstream side in the transport direction. Therefore, if the brightness of each of the brightness acquiring areas 330 is corrected by subtracting the brightness of the corresponding areas 332, 333 of the single pattern portions 322, 323 from the brightness of respective areas 331 of the brightness acquiring areas 330, the relationship of magnitude of the brightness after the correction, which is provided between the respective areas 331 of the respective brightness acquiring areas 330, is the same as the relationship of magnitude of the brightness which is provided between the respective areas 331 of the respective brightness acquiring areas 330 when the ink is discharged normally from the nozzles 10. That is, when any abnormality arises in parts of the first-pattern 301 and the second-pattern 302, the influence of the brightness change caused by the abnormality can be excluded from the information of the brightness of the overlapped pattern portion 321.

Next, an explanation will be made about modified embodiments in which various modifications are applied to the embodiment of the present invention. However, the components or parts, which are the same as or equivalent to those of the embodiment of the present invention, are appropriately omitted from the explanation.

In the first and second embodiments, N is an odd number. However, N may be an even number. In this case, in relation to the first embodiment, [(N+1)/2] may be replaced [(N/2)+1], and [(N−1)/2] may be replaced with (N/2). Further, in relation to the second embodiment, [(N+1)/2] may be replaced with (N/2).

In the first embodiment, the brightness of the overlapped pattern portion 121 is corrected by subtracting both of the brightness of the first single pattern portion 122 and the brightness of the second single pattern portion 123 from the brightness of the overlapped pattern portion 121. However, there is no limitation thereto. The brightness of the overlapped pattern portion 121 may be corrected by subtracting only the brightness of any one of the single pattern portions 122, 123 from the brightness of the overlapped pattern portion 121. In this case, the inspection pattern 100 may have only any one of the two single pattern portions 122, 123.

Also in this case, it is possible to accurately detect the inclination of the arrangement direction of the nozzles 10 with respect to the transport direction as compared with a case in which the brightness of the overlapped pattern portion 121 is used as it is. However, the black ink is deeper or darker than the magenta ink (color ink). Therefore, when the first line pattern 111*a* is printed with the black ink, and the second line pattern 112*a* is formed with the magenta ink (color ink) as in the first embodiment, then the abnormality of the first line pattern 111*a* more greatly affects the brightness of the overlapped pattern portion 121 as compared with the abnormality of the second line pattern 112*a*. Therefore, when the brightness of the overlapped pattern portion 121 is corrected by subtracting only the brightness of any one of the single pattern portions 122, 123 from the brightness of the overlapped pattern portion 121, it is possible to accurately detect the inclination of the arrangement direction of the nozzles 10 with respect to the transport direction by subtracting only the brightness of the single pattern portion 122 printed with the black ink.

Similarly, in the second embodiment, the brightness of the overlapped pattern portion 221 may be corrected by subtracting only the brightness of any one of the single pattern portions 222, 223 from the brightness of the overlapped pattern portion 221. Further, in the third embodiment, the brightness of each of the brightness acquiring areas 320 may be corrected by subtracting only the brightness of any one of the single pattern portions 322, 323 from the brightness of each of the brightness acquiring areas 320.

Further, the brightness of the overlapped pattern portion may be corrected by using the brightness of the single pattern portion by means of any method other than the method in which the brightness of the single pattern portion is subtracted from the brightness of the overlapped pattern portion.

In the first to third embodiments, the predetermined characteristic of the printer 1 is expressed by the position of the portion at which the brightness is the highest (density is the smallest or minimum) in relation to the inspection pattern. However, there is no limitation thereto. The predetermined characteristic of the printer 1 may be expressed by the position of the portion at which the brightness is the lowest (density is the deepest or darkest) in relation to the inspection pattern.

In the first to third embodiments, the inspection pattern is comparted into the plurality of areas, the brightness is detected for each of the areas, and the area, in which the brightness is the highest, is selected therefrom. However, there is no limitation thereto. For example, an approximating curve, which fits the change of the brightness value in the plurality of areas, may be calculated by using the values of the brightness of the plurality of areas, and the position, at which the value expressed by the approximating curve is local maximum, may be selected. In this case, the position, at which the brightness is local maximum, can be selected by using the unit which is finer or smaller than the number of the areas comparted to acquire the brightness.

In the first embodiment, the first line pattern 111*a* is printed with the black ink, and the second line pattern 112*a* is printed with the magenta ink. However, there is no limitation thereto. The second line pattern 112*a* may be printed with the yellow ink or the cyan ink. Alternatively, the first line pattern 111*a* may be printed with the color ink of any color, and the second line pattern 112*a* may be printed with the color ink having a color different from the color of the first line pattern 111*a*.

Alternatively, in the first embodiment, all of the nozzles 10 for forming the four nozzle arrays 9 may be the nozzles for discharging the black ink. The first line pattern 111*a* may be printed by discharging the black ink from the nozzles 10 for forming a certain nozzle array 9, and the second line pattern 112*a* may be printed by discharging the black ink from the nozzles 10 for forming any nozzle array 9 different from the nozzle array 9 used to print the first line pattern 111*a*.

In the first embodiment, the position of the nozzles 10 in the transport direction are the same in relation to all of the four nozzle arrays 9. However, the positions of the nozzles 10 in the transport direction may be deviated from each other between the nozzle arrays 9. For example, the nozzles 10, which form the nozzle array 9 for discharging the magenta ink, may be deviated in the transport direction by an integral fraction of the length C of the nozzle array 9 or by any other quantity or amount with respect to the nozzles 10 which form the nozzle array 9 for discharging the black ink. In this case, the pattern may be constructed so that the brightness of the central block provides an extreme value in an ideal state while considering the deviation amount.

In the first embodiment, the recording paper P is not transported during the period in which the N pieces of second-partial patterns 112 are printed, and the second offset amount of the present invention is zero. However, there is no limitation thereto. The recording paper P may be transported by any second offset amount which is different from the first offset amount (minute distance D) every time when the second-partial pattern 112 is printed. In this case, the recording paper P is transported during the period in which the N pieces of second-partial patterns 112 are printed. Therefore, it is necessary that the recording paper P should be transported to adjust the position before the [(N−1)/2] pieces of the first-partial patterns ill are printed after the N pieces of second-partial patterns 112 are printed.

In the first to third embodiments, all of the deviation amounts between the adjoining partial patterns (line patterns in the third embodiment) of the N blocks of partial patterns are constant, and the first offset amount and the second offset amount have the constant values. However, the first offset amount or the second offset amount may differ for each of the adjoining partial patterns. For example, when the offset amount is decreased for the partial pattern disposed in the vicinity of the center of the plurality of partial patterns, and the offset amount is increased for the partial pattern disposed at the position far from the center, then the brightness of any one of the N pieces of partial patterns can provide an extreme value even in the case of an apparatus having large deviation, while securing the adjustment accuracy of the apparatus by adjusting the apparatus to be in such a state that the brightness of the central partial pattern finally provides an extreme value. That is, both of the high adjustment accuracy and the wide adjustment range can be established by using one pattern.

In the first to third embodiments, the explanation has been made about the factor of the occurrence of the abnormality in the line pattern, inherent in each of the embodiments. However, the factor of the occurrence of the abnormality in the line pattern is not limited thereto. For example, the abnormality also occurs in the line pattern in some cases when the voltage, which is supplied to the printer 1 from an external power source, is temporarily unstable. In other cases, the abnormality also occurs in the line pattern when the surface, on which the printer 1 is arranged, is greatly vibrated during the printing of the inspection pattern. In the case of the printer 1 in which the printing is performed by discharging the ink from the nozzles 10 while reciprocatively moving the carriage 11 in the scanning direction, the direction of the force applied to the ink contained in the ink-jet head 12 when the carriage 11 is accelerated or decelerated is oppositely directed between the situation in which the carriage 11 is moved to the right side and the situation in which the carriage 11 is moved to the left side. Thus, the abnormality sometimes arises in the line pattern due to the difference in the force applied to the ink contained in the ink-jet head 12. These factors are the factors common to the first to third embodiments.

The inspection pattern to be printed by the printer 1 is not limited to the inspection patterns 100, 200, 300 of the first to third embodiments. The inspection pattern may be any other pattern including an overlapped pattern portion in which two patterns are overlapped with each other and single patterns in each of which only one of the two patterns is formed. In this arrangement, each of the two patterns is not limited to a pattern formed by a plurality of line patterns. For example, it is also allowable to use, for example, a pattern in which a certain area of the recording paper P is painted over. Further, in this arrangement, the inspection pattern may indicate or express the characteristic of the printer 1 different from those explained in the first to third embodiments.

In this case, any condition differs between when the first-pattern is printed and when the second-pattern is printed, for example, such that the discharge speed and/or the volume of the ink discharged from the nozzle 10 differs or differ between when the first-pattern is printed and when the second-pattern is printed, depending on what inspection pattern is printed. Such a pattern can be constructed that the information, which relates to any characteristic of the printer 1 allowed to appear as the difference between the conditions, is acquired by using the deviation of the ink landing position to be caused between the different conditions. Further, in any case, any abnormality arises in a part of the first-pattern and/or a part of the second-pattern, for example, when the voltage supplied to the printer 1 from the external power source is temporarily unstable as described above and/or when the surface, on which the printer 1 is arranged, is greatly vibrated during the printing of the inspection pattern. Therefore, even in such situations, it is possible to exclude the influence of the change of the brightness caused by the abnormality by correcting the information of the brightness of the overlapped pattern portion with the information of the brightness of the single pattern portion.

In the first to third embodiments, the inspection patterns 100, 200, 300 are read by the read unit 5 of the printer 1. However, there is no limitation thereto. The inspection patterns 100, 200, 300 may be read, for example, by a scanner provided separately from the printer 1. In this case, for example, the information of the position of the portion having the highest brightness of the overlapped pattern portion after the correction may be inputted into the printer 1 by operating the operation unit 6 of the printer 1.

The foregoing explanation has been made about the exemplary case in which the present invention is applied when the inspection image is printed by the ink-jet printer provided with the so-called serial type ink-jet head for performing the printing by discharging the ink from the nozzles while moving the carriage in the scanning direction, and the printed inspection image is read. However, there is no limitation thereto. The present teaching is also applicable when an inspection image is printed by an ink-jet printer provided with a so-called line head extending over the entire length in the widthwise direction of the recording paper P, and the printed inspection image is read. Further, the present invention is also applicable when an inspection image is printed by a printer other than the ink-jet printer, including, for example, an industrial printer for discharging any liquid other than the ink from nozzles and a printer such as a laser printer for performing the printing other than the method for discharging the liquid from the nozzles, and the printed inspection image is read.

What is claimed is:

1. A pattern inspection apparatus configured to inspect a print pattern printed on a medium by a printer, comprising:

a reading mechanism configured to read the print pattern including an overlapped pattern portion in which a first-pattern and a second-pattern are overlapped and a single pattern portion in which one of the first-pattern and the second-pattern is formed without overlapping; and a controller configured to acquire density information of the print pattern based on a result of the reading performed by the reading mechanism and to correct density information of the overlapped pattern portion by using density information of the single pattern portion.

2. The pattern inspection apparatus according to claim 1, wherein the first-pattern includes a plurality of first line patterns formed by lines extending in an extending direction;

the second-pattern includes a plurality of second line patterns formed by lines extending in the extending direction;

a degree of overlap between the first line patterns and the second line patterns in a direction perpendicular to the extending direction differ at the overlapped pattern portion in relation to respective sets of the first line patterns and the second line patterns; and the controller is configured to extract a portion at which a density of the overlapped pattern portion has an extreme value, from the acquired density information of the overlapped pattern portion, and to specify a position at which the degree of overlap between the first line pattern and the second line pattern is local maximum or local minimum.

3. The pattern inspection apparatus according to claim 2, wherein the printer includes:

an ink-jet head which is configured to discharge ink from a plurality of nozzles while moving in a scanning direction perpendicular to the extending direction, the plurality of nozzles being arranged to form a plurality of nozzle arrays aligned in the scanning direction such that the nozzle arrays extend in a transport direction respectively;

a transport mechanism which is configured to transport the medium in the transport direction parallel to the extending direction; and a print controller which is configured to control the ink-jet head and the transport mechanism such that:

the plurality of first line patterns, each of which is arranged while being deviated by a first offset amount in the transport direction, are printed by using the nozzles belonging to a certain first nozzle array while moving the ink-jet head in the scanning direction; and the plurality of second line patterns, each of which is arranged while being deviated by a second offset amount different from the first offset amount in the transport direction, are printed by using the nozzles belonging to a second nozzle array different from the first nozzle array while moving the ink-jet head in the scanning direction; and the controller is configured such that an inclination of an arrangement direction of the nozzles with respect to the transport direction is detected based on the specified position.

4. The pattern inspection apparatus according to claim 1, wherein the printer is an ink-jet printer; and the first-pattern and the second-pattern are patterns formed with inks discharged from different nozzles of the ink-jet printer respectively.

5. The pattern inspection apparatus according to claim 1, wherein the printer is an ink-jet printer; and at least one of the first-pattern and the second-pattern is formed with black ink.

6. The pattern inspection apparatus according to claim 5, wherein the first-pattern is formed with the black ink;

the second-pattern is formed with ink having a color different from black;

only the first-pattern of the black ink is formed at the single pattern portion; and the controller is configured to correct the density information of the plurality of overlapped pattern portions by using the density information of the single pattern portion formed with the black ink.

7. The pattern inspection apparatus according to claim 1, wherein the print pattern has a first single pattern portion in which only the first-pattern is formed and a second single pattern portion in which only the second-pattern is formed; and the controller is configured to correct the density information of the overlapped pattern portion by using both of the density information of the first single pattern portion and the density information of the second single pattern portion.

8. A pattern inspection method for inspecting a print pattern printed on a medium by a printer, comprising:

reading, by a reading apparatus, the print pattern printed on the medium by the printer, the print pattern including an overlapped pattern portion in which a first-pattern and a second-pattern are overlapped and a single pattern portion in which one of the first-pattern and the second-pattern is formed without overlapping;

acquiring density information of the print pattern based on a result of the reading; and correcting density information of the overlapped pattern portion by using density information of the single pattern portion.

9. The pattern inspection method according to claim 8, further comprising printing the print pattern including the overlapped pattern portion and the single pattern portion on the medium.

10. The pattern inspection method according to claim 8, wherein the first-pattern includes a plurality of first line patterns formed by lines extending in an extending direction;

the second-pattern includes a plurality of second line patterns formed by lines extending in the extending direction;

a degree of overlap between the first line patterns and the second line patterns in a direction perpendicular to the extending direction differ at the overlapped pattern portion in relation to respective sets of the first line patterns and the second line patterns; and the method further comprises extracting a portion at which a density of the overlapped pattern portion has an extreme value, from the acquired density information of the overlapped pattern portion, and specifying a position at which the degree of overlap between the first line pattern and the second line pattern is local maximum or local minimum.

11. The pattern inspection method according to claim 10, wherein the printer includes:

an ink-jet head which is configured to discharge ink from a plurality of nozzles while moving in a scanning direction perpendicular to the extending direction, the plurality of nozzles being arranged to form a plurality of nozzle arrays aligned in the scanning direction such that the nozzle arrays extend in a transport direction respectively;

a transport mechanism which is configured to transport the medium in the transport direction parallel to the extending direction; and a print controller which is configured to control the ink-jet head and the transport mechanism such that:

the plurality of first line patterns, each of which is arranged while being deviated by a first offset amount in the transport direction, are printed by using the nozzles belonging to a certain first nozzle array while moving the ink-jet head in the scanning direction; and the plurality of second line patterns, each of which is arranged while being deviated by a second offset amount different from the first offset amount in the transport direction, are printed by using the nozzles belonging to a second nozzle array different from the first nozzle array while moving the ink-jet head in the scanning direction; and the inspection method further comprises detecting an inclination of an arrangement direction of the nozzles with respect to the transport direction based on the specified position.

12. The pattern inspection method according to claim 8, wherein the printer is an ink-jet printer; and the first-pattern and the second-pattern are patterns formed with ink discharged from different nozzles of the ink-jet printer respectively.

13. The pattern inspection method according to claim 8, wherein the printer is an ink-jet printer; and at least one of the first-pattern and the second-pattern is formed with black ink.

14. The pattern inspection method according to claim 8, wherein the first-pattern is formed with black ink;

the second-pattern is formed with ink having a color different from black;

only the first-pattern of the black ink is formed at the single pattern portion; and the density information of the plurality of overlapped pattern portions is corrected by using the density information of the single pattern portion formed with the black ink.

15. The pattern inspection method according to claim 8, wherein the print pattern has a first single pattern portion in which only the first-pattern is formed and a second single pattern portion in which only the second-pattern is formed; and the density information of the overlapped pattern portion is corrected by using both of the density information of the first single pattern portion and the density information of the second single pattern portion.

16. A printer configured to perform printing on a medium, comprising:

a print unit which is configured to print a print pattern on the medium;

a read unit which is configured to read the print pattern printed on the medium; and a controller which is configured to control the print unit and the read unit to perform:

printing of the print pattern including an overlapped pattern portion in which a first-pattern and a second-pattern are overlapped and a single pattern portion in which one of the first-pattern and the second-pattern is formed without overlapping, by controlling the print unit;

acquisition of density information of the print pattern based on a result of the reading; and correction of density information of the overlapped pattern portion by using density information of the single pattern portion.

17. The printer according to claim 16, wherein the first-pattern includes a plurality of first line patterns formed by lines extending in an extending direction;

the second-pattern includes a plurality of second line patterns formed by lines extending in the extending direction;

a degree of overlap between the first line patterns and the second line patterns in a direction perpendicular to the extending direction differ at the overlapped pattern portion in relation to respective sets of the first line patterns and the second line patterns; and the controller is configured to extract a portion at which a density of the overlapped pattern portion has an extreme value, from the acquired density information of the overlapped pattern portion, and to specify a position at which the degree of overlap between the first line pattern and the second line pattern is local maximum or local minimum.

18. The printer according to claim 17, wherein the print unit includes:

an ink-jet head which is configured to discharge ink from a plurality of nozzles while moving in a scanning direction perpendicular to the extending direction, the plurality of nozzles being arranged to form a plurality of nozzle arrays aligned in the scanning direction such that the nozzle arrays extend in a transport direction respectively; and a transport mechanism which is configured to transport the medium in the transport direction parallel to the predetermined direction, the controller controls the ink-jet head and the transport mechanism such that:

the plurality of first line patterns, each of which is arranged while being deviated by a first offset amount in the transport direction, are printed by using the nozzles belonging to a certain first nozzle array while moving the ink-jet head in the scanning direction; and the plurality of second line patterns, each of which is arranged while being deviated by a second offset amount different from the first offset amount in the transport direction, are printed by using the nozzles belonging to a second nozzle array different from the first nozzle array while moving the ink-jet head in the scanning direction; and the controller is configured such that an inclination of an arrangement direction of the nozzles with respect to the transport direction is detected based on the specified position.

* * * * *